US012790096B1

(12) United States Patent
Kotowksi-Chang et al.

(10) Patent No.: US 12,790,096 B1
(45) Date of Patent: Nov. 10, 2026

(54) BEVERAGE-COMPATIBLE CONTAINER WITH RESISTANCE TO DEGRADATION

(71) Applicant: Archer Roose, Inc., Boston, MA (US)

(72) Inventors: Jan Kotowksi-Chang, N Bellmore, NY (US); Marian Leitner, Dartmouth, MA (US)

(73) Assignee: Archer Roose, Inc., Boston, MA (US)

( * ) Notice: Subject to any disclaimer, the term of this patent is extended or adjusted under 35 U.S.C. 154(b) by 0 days.

(21) Appl. No.: 19/384,413

(22) Filed: Nov. 10, 2025

(51) Int. Cl.

| | |
|---|---|
| ***B65D 81/26*** | (2006.01) |
| ***B65D 17/00*** | (2006.01) |
| ***B65D 25/14*** | (2006.01) |
| ***B65D 65/40*** | (2006.01) |

(52) U.S. Cl.
CPC ..... *B65D 81/266* (2013.01); *B65D 17/02* (2013.01); *B65D 25/14* (2013.01); *B65D 65/40* (2013.01); *B65D 2565/387* (2013.01)

(58) Field of Classification Search
USPC ..... 220/62.11, 62.12, 592.2–592.27, 917; 426/131, 398
See application file for complete search history.

(56) References Cited

U.S. PATENT DOCUMENTS

| | | | | |
|---|---|---|---|---|
| 7,981,515 | B2 * | 7/2011 | Ambrose | C08G 63/668 525/445 |
| 8,074,483 | B2 * | 12/2011 | Kojima | B32B 1/00 72/379.4 |
| 8,168,276 | B2 * | 5/2012 | Cleaver | B65D 25/34 428/35.8 |
| 9,410,251 | B2 * | 8/2016 | Tadaki | B32B 15/08 |
| 12,252,610 | B2 * | 3/2025 | Xie | B32B 15/18 |
| 2003/0059561 | A1 * | 3/2003 | Ueda | B65D 23/02 428/35.7 |
| 2019/0048300 | A1 | 2/2019 | Gatewood et al. | |
| 2022/0242610 | A1 * | 8/2022 | Widitora | B32B 15/08 |

FOREIGN PATENT DOCUMENTS

| | | | |
|---|---|---|---|
| JP | 2006264734 | A | 10/2006 |
| JP | 2014114054 | A | 6/2014 |

* cited by examiner

*Primary Examiner* — Bryon P Gehman
(74) *Attorney, Agent, or Firm* — CALDWELL LLC

(57) ABSTRACT

A beverage-compatible container including a body including a sidewall with an interior surface forming a cavity configured to hold an acidic or reactive beverage. The container includes a liner disposed on at least a portion of the interior surface and configured to chemically isolate the interior surface of the body from the acidic or reactive beverage by resisting corrosion, oxidation, and sulfur-induced degradation; and preserve oxygen and sulfur barrier performance throughout storage of the acidic or reactive beverage within the body.

20 Claims, 23 Drawing Sheets

Supplemental Table 1 Initial composition of wines used in long-term canning study. TA, titratable acidity; ABV, alcohol by volume.

| Wine | Vintage | Composition | Alcohol (% ABV) | TA (g/L) | pH | Residual sugar (g/L) | Free $SO_2$ (mg/L) | $mSO_2$ (mg/L)[a] | Aluminum (mg/L) | Free $SO_2$ (mg/L): Treatment II and III | $mSO_2$ (mg/L): Treatment II | $mSO_2$ (mg/L): Treatment III |
|---|---|---|---|---|---|---|---|---|---|---|---|---|
| Pinot grigio | 2021 | 100% Pinot grigio | 12.1% | 6.7 | 3.37 | 0.0 | 16 | 0.59 | 1.17 | 38 | 1.40 | 0.58 |
| Sauvignon blanc | 2021 | 100% Sauvignon blanc | 12.1% | 7.40 | 3.28 | 1.2 | 15 | 0.68 | 1.15 | 35 | 1.58 | 0.67 |
| French rosé | 2019 | 60.2% Grenache noir; 26.5% Syrah; 8% Carignon; 5% Grenache blanc; 0.3% Ugni blanc | 12.7% | 6.10 | 3.30 | 0.6 | 21 | 0.93 | 1.16 | 51 | 2.28 | 0.57 |
| Sparkling rosé | NV | 90% Glera, 10% Pinot noir | 11.2% | 5.79 | 3.20 | 9.5 | 20.5 | 1.07 | 0.61 | 45 | 2.36 | 0.72 |
| Sparkling white | NV | 100% Glera | 10.5% | 5.60 | 3.11 | 10.9 | 15 | 0.93 | 1.11 | 41 | 2.49 | 0.69 |

[a]$mSO_2$, molecular $SO_2$, calculated from pH and free $SO_2$ using alcohol-adjusted acid dissociation constant ($pK_a$) values.

FIG. 11

Supplemental Table 2 Parameters for open circuit potential testing.

| **Pretreatment settings** | |
|---|---|
| E condition 1 | 0 V |
| t condition 1 | 0 sec |
| E condition 2 | 0 V |
| t condition 2 | 0 sec |
| **Corrosion potential settings** | |
| t interval | 1 sec |
| t run | 3600 sec |

FIG. 12A

Supplemental Table 3 Parameters for electrochemical impedance spectroscopy testing. OCP, open circuit potential; DC, direct current; AC, alternating current.

| **Pretreatment settings** | |
|---|---|
| E condition 1 | 0 V |
| t condition 1 | 0 sec |
| E condition 2 | 0 V |
| t condition 2 | 0 sec |
| **Impedance spectroscopy settings** | |
| t equilibration | 0 sec |
| Scan type | Fixed |
| E DC | 0 V |
| E AC | 0.01 V |
| Frequency type | Scan |
| n frequencies | 67 |
| Max frequency | 50,000 Hz |
| Min frequency | 0.01 Hz |
| Measure versus OCP | Checked |
| E DC versus OCP | Checked |
| t max OCP | 5 sec |
| Stability criterion | 0.1 mV/sec |
| t min sampling | 0.1 sec |
| t max equilibration | 0.01 sec |

FIG. 12B

BEVERAGE-COMPATIBLE CONTAINER WITH RESISTANCE TO DEGRADATION

FIELD OF THE INVENTION

The present invention generally relates to the field of beverage containing devices. In particular, the present invention is directed to a beverage-compatible container with resistance to degradation.

BACKGROUND

Aluminum cans are widely adopted for carbonated soft drinks and beer, where liner chemistries are well established and beverage interactions are relatively predictable. However, acidic beverages such as wine, kombucha, and *Cannabis*-infused drinks present unique challenges due to their low pH, high titratable acidity, and volatile sulfur compound content. These properties accelerate chemical reactions with can liners, leading to premature product failure.

SUMMARY OF THE DISCLOSURE

In an aspect, a beverage-compatible container including a body including a sidewall with an interior surface forming a cavity configured to hold an acidic or reactive beverage. The container includes a liner disposed on at least a portion of the interior surface and configured to chemically isolate the interior surface of the body from the acidic or reactive beverage by resisting corrosion, oxidation, and sulfur-induced degradation; and preserve oxygen and sulfur barrier performance throughout storage of the acidic or reactive beverage within the body.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein:

FIG. 11 is a table illustrating initial composition of wines used in a long-term canning study;

FIG. 12A, is a table of parameters for open circuit potential testing;

FIG. 12B is a table of parameters for electrochemical impedance spectroscopy testing;

DETAILED DESCRIPTION

At a high level, aspects of the present disclosure are directed to a beverage-compatible container including a body including a sidewall with an interior surface forming a cavity configured to hold an acidic or reactive beverage. The container includes a liner disposed on at least a portion of the interior surface and configured to chemically isolate the interior surface of the body from the acidic or reactive beverage by resisting corrosion, oxidation, and sulfur-induced degradation; and preserve oxygen and sulfur barrier performance throughout storage of the acidic or reactive beverage within the body.

Aspects of the present disclosure can be used to improve shelf stability, reduce metal ion migration, and maintain sensory integrity of beverages during long-term storage. Aspects of the present disclosure can also be used to enhance packaging performance under varying thermal and pressure conditions, including hot-fill and carbonation processes. This is so, at least in part, because the disclosed embodiments of a liner provide a multi-layer chemical barrier system that cooperates mechanically with a container body to suppress corrosion, limit oxygen ingress, and prevent sulfur-metal interactions that would otherwise lead to off-aroma formation and structural degradation.

Exemplary embodiments illustrating aspects of the present disclosure are described below in the context of several specific examples.

Figure 1:
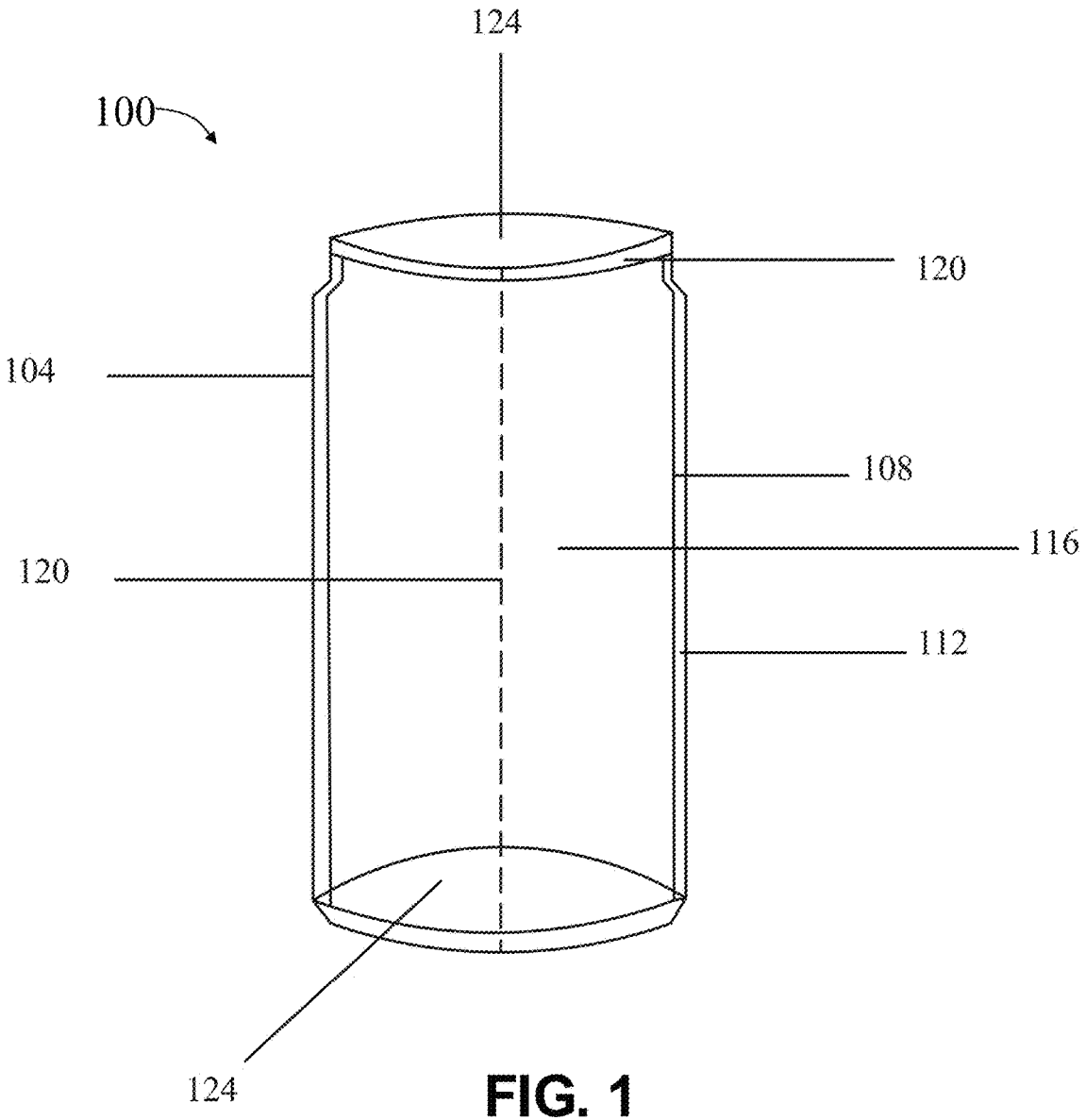
FIG. 1 exemplary illustration on a beverage-compatible container with resistance to degradation.

Referring now to FIG. 1, an exemplary embodiment of a beverage-compatible container, apparatus or system 100 with resistance degradation is illustrated. As used herein, a "container" is an article of manufacture that defines an enclosed interior volume bounded by one or more walls and at least one closure interface. Container 100 may be configured to receive, retain, protect, and dispense a beverage or other flowable material while inhibiting ingress or egress of gases, vapors, and liquids under specified handling, storage, and processing conditions. In some embodiments, the resistance is to sulfur and oxygen induced degradation. As used herein, "degradation" is any adverse change in material or product performance arising from chemical, electrochemical, or physical processes. Degradation may include under-film corrosion, hydrolysis, oxidation, plasticization, embrittlement, blistering, delamination, pin holing, or loss of barrier properties. For the contained beverage, degradation is any decline in sensory or compositional quality attributable to package interactions, including generation or uptake of off-aroma compounds (e.g., hydrogen sulfide), oxygen ingress, color/body changes, or metal-related taste faults.

With continued reference to FIG. 1, container 100 may include a body 104 and a liner 108. As used herein, a "body" is the structural shell of the container or can. Body 104 may be formed of drawn and ironed aluminum alloy or tin-coated steel that defines a cylindrical sidewall, a base dome, and an upper opening flange adapted to receive a seamed lid. As used herein, a "liner" is a continuous or multi-layer coating composition disposed along at least a portion of the interior surface of a body, configured to chemically and physically isolate a contained beverage from a body substrate. As used herein, "interior surface" is a continuous, beverage-facing surface of a container that bounds the interior volume. The interior surface 112 encompasses the native substrate (e.g., metal oxide, glass, polymer) and any pretreatments, primers, or coatings to which liner 108 is applied or with which a contained beverage directly interfaces. Body 104 may include a cavity 116 configured to hold an acidic or reactive beverage. As used herein, "cavity" is the enclosed interior volume bounded by the interior surface of the body. As used herein, "beverage" is a consumable liquid formulation. In one or more embodiments, liner 108 is configured to preserve oxygen and sulfur barrier performance throughout storage of an acidic or reactive beverage contained within body 104. In some embodiments, liner 108 may maintain a low effective oxygen transmission and suppress permeation and/or surface reactivity of volatile sulfur compounds (e.g., $H_2S$, $SO_2$ and related species) so that sensory quality and package integrity are sustained during filling, distribution, and normal temperature excursions. In some embodiments, such barrier performance may be maintained over extended storage durations (e.g., at least about 24 months, optionally 30-36 months or longer, depending on beverage chemistry and processing), while accommodating forming, seaming, and thermal cycles without loss of continuity or adhesion. Liner 108 may be configured to chemically isolate the interior surface 112 of body 104 from an acidic or reactive beverage by forming a continuous, adherent barrier that resists corrosion, oxidation, and sulfur-induced degradation at the metal—beverage interface. As used herein, "chemically isolate" means to prevent or substantially limit direct chemical interaction between the beverage and the substrate. This may include suppression of metal-ion dissolution, under-film corrosion, redox reactions, and adsorption/desorption of volatile sulfur compounds—such that the substrate remains passivated, the liner maintains adhesion and integrity across formed features and seams, and sensory or compositional changes attributable to package interactions are minimized over the intended shelf life.

With continued reference to FIG. 1, in exemplary embodiments, liner 108 may include a BPA-free epoxy, polyester, or hybrid polymer resin containing cross-linking agents, adhesion promoters, and corrosion-inhibiting fillers formulated to resist sulfur- and oxygen-induced degradation under extended acidic exposure. The body 104 may be fabricated from aluminum alloy sheet material by a draw-and-iron process, which elongates and thins the sidewall to reduce mass while maintaining mechanical strength. As used herein, a "draw-and-iron process" refers to a metal-forming sequence used to manufacture thin-walled, seamless aluminum can bodies. The process typically includes drawing—a flat aluminum alloy blank is stamped by a punch and die to form a shallow cup; ironing—the cup is then forced through a series of precision rings that progressively thin and elongate its sidewall while maintaining the original base thickness; and trimming and forming—the open end is trimmed to a uniform height and flanged for lid attachment. In some embodiments, the draw-and-iron process may employ lubricated dies and controlled temperature to achieve wall-thickness reductions of 30-50% without tearing. The resulting body 104 may exhibit anisotropic grain orientation that increases hoop strength, enabling internal pressures of 60-90 psi typical of carbonated or thermally processed beverages while minimizing total metal mass. The smooth, continuous interior surface 112 produced by the ironing operation provides an optimal substrate for uniform deposition and adhesion of liner 108, reducing the likelihood of pinholes or thin regions that can accelerate corrosion when in contact with acidic or sulfur-rich beverages.

With continued reference to FIG. 1, in alternative embodiments, body 104 may include other materials compatible with the disclosed liner architecture. In some embodiments, a steel substrate may be used, including electrolytic-tinplate (ETP) or tin-free steel (TFS), with pre-treatments adapted to accept liner 108 and to suppress under-film corrosion at formed seams. In some embodiments, stainless steel (e.g., an austenitic grade) may be selected for enhanced mechanical robustness or reusability, with liner 108 formulated for adhesion to chromium-rich oxides. In some embodiments, a polymeric container (e.g., PET or a multilayer PET/barrier structure) or a metal-polymer laminate may be employed, wherein liner 108 may be simplified to a barrier/surface-protection stack optimized for organic-acid and volatile-sulfur exposure. In some embodiments, glass may serve as body 104 for thermal-process applications, with liner 108 reduced or omitted where inertness is sufficient, or retained as a functional barrier where sulfur adsorption or oxygen ingress at closures is of concern. Across these alternatives, dimensional targets, thermal-process compatibility, and double-seam or closure interfaces may be selected to maintain liner 108 continuity and barrier performance during filling, carbonation, and storage.

With continued reference to FIG. 1, body 104 may include a sidewall 120, a base dome 124, and an upper flange 128 configured to mate with a lid 132. As used herein, "sidewall" is the continuous section of a body that defines the boundary of the can and contains the beverage. The sidewall 120 may define an interior volume, which is the internal space configured to receive an acidic beverage composition such as wine, kombucha, or *Cannabis*-infused beverages. Sidewall 120 may be a continuous cylindrical section of a body that define a vertical boundary. As used herein, "base dome" is the concave lower end of a body formed inward during manufacture. The base dome 124 may include a central concave geometry, which distributes axial and radial forces resulting from carbonation or thermal expansion, thereby preventing permanent deformation or "paneling" of the can during storage or pasteurization. Based dome 124 may configured to enhance pressure tolerance. As used herein, "flange" is the outwardly rolled rim at an upper end of a body, configured to interface with a lid. The flange 128 may include a double-seam contact region, which is a circumferential joining zone where the lid curl and the can flange are interlocked and compressed to form a hermetic seal. Flange 128 may interface with lid 132 through a mechanical double-seam process. As used herein, a "mechanical double-seam process" is a closure-forming sequence that plastically interlocks a container flange and a lid curl by two staged rolling operations about a seaming chuck to create a multi-layer seam encapsulating a sealing compound, thereby producing a gas- and liquid-tight joint. In some embodiments, the internal radii at transitions between sidewall 120 and base dome 124 may be coated to uniform thickness with liner 108 to prevent stress-point delamination, a failure mode characterized by localized separation of the liner from the metal substrate under high curvature and chemical attack. The uniform liner coverage in these transitional radii may maintain adhesion and corrosion resistance even under cyclic pressure and temperature variations, thereby extending the usable shelf life of acidic beverage products.

With continued reference to FIG. 1, the process of coating the interior surface 112 of body 104, including the transitional radii between sidewall 120 and base dome 124, may involve applying a liquid or powder-formulation of liner 108 that undergoes flow, wetting, and subsequent curing to form a continuous polymeric film. As used herein, "coating" refers to the deposition and solidification of a material onto a substrate to create an adherent layer that serves as a chemical and mechanical barrier. The substrate may be metallic. In some embodiments, the coating may be applied via electrostatic spray deposition, roller coating, or flow coating, each method being selected based on can geometry and target film thickness. The coating may spread over the internal surfaces by surface-tension-driven leveling before being thermally cured at temperatures between approximately 170° C. and 220° C. to cross-link the polymer network. During curing, the polymer's viscosity and surface energy may be controlled so that the coating conforms uniformly across high-curvature regions such as the dome and shoulder without forming thin spots or voids. In exemplary configurations, the applied film may achieve a cured thickness ranging between 4 μm and 12 μm, with localized variation not exceeding ±10% to ensure consistent mechanical performance. The resulting coated interface may provide a dual-function barrier-mechanically resisting strain localization under pressure cycling and chemically blocking electrolyte penetration into the aluminum oxide layer. The coating adhesion may further be enhanced by an organophosphate or silane-based adhesion sublayer, which forms covalent bonds to the oxide surface and interpenetrates the polymer matrix, preventing under-film corrosion even when exposed to acidic or sulfur-rich beverages. This coating architecture ensures that liner 108 maintains long-term adhesion and chemical inertness in reactive beverage environments, thereby extending the durability and sensory stability of the packaged product throughout its intended 12-24-month shelf life.

With continued reference to FIG. 1, liner 108 may be applied to body 104 using an electrostatic spray or roller-coat process followed by thermal curing between approximately 170° C. and 220° C. for 1 to 5 minutes, producing a cross-linked polymer network adhered to the native metal-oxide layer of body 104. As used herein, "cross-linked polymer network" is a three-dimensional matrix of polymer chains covalently bonded through reactive groups such as epoxides, hydroxyls, or carboxyls to form a dense structure that resists diffusion of reactive species including oxygen, sulfur dioxide, and hydrogen sulfide. In some embodiments, liner 108 may include a multilayer architecture comprising (i) a functional barrier layer, (ii) a surface layer, and (iii) an adhesion-promoter sublayer. As used herein, "functional barrier layer" is a chemically cross-linked polymer layer of a liner configured to impede permeation of reactive species including oxygen and volatile sulfur compounds while resisting hydrolysis and acid attack across the interior surfaces of a body. The functional barrier layer may include epoxy-polyester, epoxy-amine, or hybrid copolymers whose backbones are engineered for high acid and sulfur resistance. As used herein, "adhesion-promoter sublayer" is a primer layer interposed between a liner and the native aluminum oxide of a body configured to form chemical bonds that couple the polymer network to the metal substrate and suppress under-film corrosion initiation at geometric stress regions. The adhesion-promoter sublayer may include organophosphate or silane coupling agents that chemically anchor the polymer network to the aluminum substrate by bonding to surface hydroxyls on the metal oxide layer, thereby improving delamination resistance. As used herein, "surface layer" is the outermost film of a liner that interfaces directly with the stored beverage and provides mechanical protection and chemical passivation. The surface layer may incorporate nanoparticulate fillers such as silica, alumina, or titanium dioxide uniformly dispersed within the polymer matrix to increase hardness, scratch resistance, and blister suppression during carbonation or pasteurization cycles. In some embodiments, the surface layer may further include fluorinated or aromatic moieties to lower surface energy and repel polar acidic constituents, thereby mitigating corrosion at high titratable acidity. The smooth, low-porosity nature of the surface layer may additionally serve as a barrier against sulfur-containing gases by reducing diffusion pathways and adsorption sites, ensuring that beverage aroma and color stability are preserved throughout extended storage durations of twelve to twenty-four months or longer.

With continued reference to FIG. 1, as used herein, "fluorinated moiety" is a chemically bound functional group containing carbon-fluorine bonds that imparts oleophobic and hydrophobic character to a polymer surface. For example, perfluoroalkyl acrylate side chains, vinylidene fluoride segments, or fluorinated urethane blocks. As used herein, "aromatic moiety" is a chemically bound functional group comprising one or more conjugated ring structures that increases cohesive energy density and π-π stacking interactions to enhance barrier compactness and solvent resistance. For example, phenyl, naphthyl, benzoxazine-derived, or cardanol-derived phenyl groups. As used herein, "surface energy" is the thermodynamic work per unit area required to create a new surface, commonly inferred by liquid contact-angle measurements on a coated film under controlled temperature and humidity.

With continued reference to FIG. 1, incorporation strategies for the surface layer may include (i) copolymerization of low-molar-ratio perfluoroalkyl acrylates or vinylidene fluoride comonomers into an epoxy-polyester or polyester-urethane surface binder; (ii) post-functional grafting of fluorinated urethane segments via isocyanate-terminated oligomers that react with residual hydroxyl or epoxy groups; (iii) physical dispersion of submicron fluoropolymer lattices (for example, polyvinylidene fluoride or polytetrafluoroethylene microdispersions) stabilized with liner-compatible surfactants; and (iv) introduction of aromatic enrichment through benzoxazine-derived cross-linkers or cardanol-based phenolic modifiers to increase glass transition temperature and reduce segmental mobility at the coating-beverage interface. Inclusion levels may be selected to balance repellency and adhesion, for example 0.1-3.0 weight percent of fluorinated solids relative to total surface-layer solids and 1-10 weight percent of aromatic cross-linker equivalents, with gradient placement favoring enrichment within the outer 100-500 nanometers of the surface layer.

With continued reference to FIG. 1, the surface layer may be engineered to self-segregate during cure so that fluorinated moieties preferentially migrate toward the air-coating interface, yielding water contact angles at or above 95-105 degrees and contact angles for 0.5-1.0 percent acetic-acid test solutions at or above 85 degrees under standard laboratory conditions. To control over-migration and preserve seam-area adhesion, tie-chemistry in an adhesion-promoter sublayer may include silane or organophosphate functionalities that anchor the surface layer through covalent bonds and hydrogen-bond networks, while a controlled cross-link density in the surface layer limits mobile extractables. In some embodiments, corona or plasma pretreatment of the cured barrier core layer may be applied immediately before surface-layer deposition to tune wettability, followed by thermal or UV cure profiles that lock in fluorinated and aromatic distributions without blister formation.

With continued reference to FIG. 1, the surface layer may further be formulated to resist deposition of acidic beverage constituents and surfactant micelles by lowering surface free energy and minimizing specific acid-base interactions. Non-reactive fluorinated additives may be avoided in favor of covalently bound species to reduce migration into the beverage; selection of low-migratory cross-linkers and post-cure bake steps may reduce residual monomers below sensory thresholds relevant to wine, kombucha, and terpene-containing matrices. Mechanical robustness of the modified surface may be verified by tape-adhesion, solvent double-rub, and abrasion tests, while chemical robustness may be verified by immersion challenges in model organic-acid solutions and volatile sulfur environments with monitoring of hydrogen sulfide headspace. In seam regions, the fluorinated or aromatic enrichment may be tapered or masked to maintain elastoplastic conformity under double-seam compression, with local adhesion maintained by the sublayer coupling chemistry and by controlled surface-layer thickness (for example, 0.5-3 micrometers) that accommodates strain without cracking.

With continued reference to FIG. 1, In some embodiments, liner 108 may include additives formulated to neutralize or inhibit reactive species generated by acidic beverages. Examples may include metal chelators (e.g., EDTA, citric acid derivatives) to bind copper or iron ions that catalyze hydrogen sulfide formation; oxygen-scavenging agents (e.g., ascorbate salts, phenolic antioxidants) to reduce oxidative stress on the liner; and sulfur-trapping fillers (e.g., zinc oxide, copper complexes immobilized in the polymer matrix) to prevent penetration of volatile $H_2S$. As used herein, "acidic beverage" refers to any liquid formulation having a pH below 4.5. Acidic beverages may contain organic acids (e.g., tartaric, malic, citric) or volatile sulfur compounds capable of reacting with aluminum surfaces. The chemical interaction between liner 108 and the beverage may thus be controlled by a combination of cross-link density, functional group distribution, and liner thickness, which may range from 4 to 12 microns across the interior surface 112 of body 104.

With continued reference to FIG. 1, body 104 may further include a coating characterization parameter referred to herein as a liner coverage profile. Liner 108 may be applied to body 104 in one or more coating passes to ensure adequate deposition thickness across all regions of the can, including the dome and sidewall. As used herein, a "liner coverage profile" refers to a quantifiable measure of a liner thickness and uniformity across geometric zones of a body. The liner coverage profile may vary locally due to spray angle, electrostatic charge distribution, or gravitational flow during curing, and therefore uniformity may be enhanced through process optimization such as multi-axis rotation or pulse-spray control. In some embodiments, the coverage of liner 108 may be verified through non-destructive inspection techniques such as infrared thermography or eddy-current sensing, which may detect sub-micron thickness deviations or metal exposure sites that increase susceptibility to corrosion. Thin areas near the lip, shoulder, or base radius may serve as initiation sites for delamination, particularly when exposed to acidic beverage compositions containing organic acids or volatile sulfur compounds. The measured liner coverage profile may therefore inform feedback control systems for adjusting deposition rate, curing time, or resin viscosity in subsequent coating runs. To validate the long-term stability of liner 108, accelerated aging tests may be performed to simulate storage durations between twelve and twenty-four months at temperatures ranging from 25° C. to 45° C. During these tests, cans may be filled with representative acidic beverages and monitored for gas evolution, blister formation, liner delamination, and sensory changes such as off-aroma generation. The resulting data may guide formulation optimization, for instance by adjusting the ratio of cross-linking agents or the inclusion of antioxidant fillers to improve stability against sulfur and oxygen attack.

With continued reference to FIG. 1, liner 108 may further include a functional additive package tuned to the beverage chemistry. As used herein, "functional additive package" is a collection of non-film-forming agents dispersed within one or more layers of liner 108 that modulate interfacial reactions and gas transport. In some embodiments, the functional additive package may include oxygen-scavenging agents selected from ascorbate salts or hindered phenolics; metal-ion chelators selected from ethylenediaminetetraacetic acid derivatives or citrate complexes; and sulfur-interactive moieties immobilized in the polymer network. As used herein, "sulfur-interactive moiety" is a chemically bound site within a liner configured to complex, convert, or immobilize volatile reduced sulfur species at the liner-beverage interface without leaching into interior volume. In some embodiments, sulfur-interactive moieties may include ZnO or Cu(I/II) coordination sites immobilized by carboxylate or phosphonate ligands within the barrier core layer.

With continued reference to FIG. 1, an application of liner 108 may target broad acidic categories including fruit beverages, teas, and fermented products. In some embodiments, liner 108 may be formulated with a thickness between 4 and 12 micrometers and a surface protection layer thickness between 0.5 and 3 micrometers to achieve an oxygen transmission rate at or below $10^{-6}$ $cm^3 \cdot cm/(cm^2 \cdot s \cdot Pa)$ under 25° C. and 50% relative humidity while maintaining elongation sufficient to conform to base-radius and shoulder strain during double seaming. In some embodiments, the functional additive package may be selected to maintain color neutrality and aroma inertness such that sensory attributes of the packaged product remain unchanged during accelerated aging equivalent to at least twelve months.

With continued reference to FIG. 1, a wine-oriented embodiment of liner 108 may be configured for low-pH matrices containing molecular sulfur dioxide and trace transition metals. In some embodiments, a sublayer of liner 108 may include a phosphate-functional adhesion system tuned to suppress under film corrosion nucleation at the base radius. As used herein, "under film corrosion" refers to localized chemical or electrochemical degradation that occurs at the interface between a metallic substrate and an overlying liner. The metallic substrate may include the aluminum oxide surface of body 104. Typically when corrosive agents such as acids, sulfur compounds, or dissolved oxygen infiltrate microscopic defects or pinholes in the liner and begin attacking the metal beneath it. In some embodiments, the liner 108 may incorporate chelation sites at 0.05-0.5 weight percent (chelator solids relative to total solids) to bind free copper and iron at the interface, thereby reducing catalytic pathways that convert sulfur dioxide to hydrogen sulfide. As used herein, "chelation site" refers to a chemically active locus within a liner. It may include one or more functional groups capable of forming coordination complexes with multivalent metal ions such as copper ($Cu^{2+}$) and iron ($Fe^{2+}/Fe^{3+}$). In some embodiments, chelation sites may be incorporated into the polymer backbone or as pendant moieties via ligands such as carboxylates, phosphonates, amines, or hydroxyl groups that provide electron-donating atoms (e.g., oxygen or nitrogen) to coordinate metal centers. The formation of these coordination complexes may sequester trace metals that otherwise catalyze redox cycles converting molecular sulfur dioxide ($SO_2$) into hydrogen sulfide ($H_2S$), thereby suppressing the onset of sulfur-related off-aromas and preventing under-film corrosion. In some embodiments, the distribution of chelation sites may be controlled across liner 108 by gradient polymerization or coextrusion processes so that metal-ion capture is maximized near the beverage interface, where metal migration and redox activity are most pronounced. Representative chelating agents may include ethylenediaminetetraacetic acid (EDTA), iminodiacetic acid, phosphonic acid derivatives, or citrate-based complexes covalently bonded to the polymer network. The overall chelator loading may range between approximately 0.05 and 0.5 weight percent of total liner solids, balancing ion-capture capacity with mechanical and barrier performance.

With continued reference to FIG. 1, in some embodiments, sulfur-interactive moieties may be located in a gradient near the beverage side of the barrier core layer to capture nascent hydrogen sulfide and reduce headspace accumulation during warm storage. In some embodiments, the surface protection layer may be selected for low aroma sorption to preserve varietal character. As used herein, "phosphate-functional adhesion system" refers to a chemically active sublayer or primer composition. It may include organophosphate, phosphonate, or phosphate ester functional groups capable of forming covalent or coordinative bonds with the native aluminum oxide surface of body 104. These phosphate functionalities may chelate surface aluminum ions or condense into metal-oxygen-phosphorus linkages that anchor the liner polymer network to the substrate, thereby suppressing under film corrosion and delamination under acidic or electrochemical stress. In some embodiments, the phosphate-functional adhesion system may include oligomeric species such as bisphenol-A diglycidyl phosphate esters, phenyl phosphates, or aminoethyl phosphonates dispersed at concentrations of 0.5-5 wt % within the adhesion-promoter sublayer. These molecules may exhibit dual reactivity: (i) a phosphate or phosphonate head group that binds to the metal oxide surface and (ii) reactive tail groups such as hydroxyl, amine, or epoxy moieties that cross-link with the overlying epoxy-polyester or epoxy-amine matrix of liner 108 during thermal curing. During the curing phase, localized dehydration between phosphate groups and surface hydroxyls may yield P—O—Al bonds that resist hydrolytic breakdown in low-pH environments typical of wines, kombucha, and other acidic beverages. This covalent anchoring may prevent the initiation of interfacial voids that serve as corrosion nucleation sites, particularly at high-stress regions such as the base radius. In exemplary embodiments, the phosphate-functional adhesion system may be co-deposited with a silane coupling agent or zirconium conversion coating precursor to enhance bonding uniformity and improve interfacial energy compatibility between the metal substrate and the polymeric liner, ensuring long-term mechanical and chemical stability under repeated thermal and pressure cycling.

With continued reference to FIG. 1, a kombucha-oriented embodiment of liner 108 may be configured for organic-acid-rich, live-culture beverages with residual fermentation potential and dissolved carbon dioxide. In some embodiments, the functional barrier layer of liner 108 may use a polyester-urethane network with enhanced hydrolysis resistance at pH below 3.5, and the functional additive package may emphasize oxygen-scavenging capacity to limit oxidative stress that accelerates liner hydrolysis. As used herein, "hydrolysis resistance" refers to the ability of a cured polymer network to resist acid- and moisture-driven bond cleavage so that molecular weight, crosslink density, adhesion, and barrier properties remain substantially stable under acidic aqueous exposure and typical thermal cycles. In some embodiments, the surface protection layer may include higher hardness fillers to withstand abrasion from microparticulates and to resist blister propagation when internal pressure cycles between cold storage and ambient handling. As used herein, "polyester-urethane network" refers to a polymeric matrix formed by the reaction of hydroxyl-terminated polyesters with diisocyanates, resulting in a segmented copolymer structure comprising soft polyester segments and hard urethane linkages. The polyester segments provide flexibility and adhesion to the substrate, while the urethane cross-links confer chemical resistance and mechanical strength under acidic and carbonated conditions. In some embodiments, the polyester component of the network may include aliphatic or aromatic diacids such as adipic acid, isophthalic acid, or terephthalic acid reacted with polyols such as neopentyl glycol or 1,6-hexanediol. The resulting prepolymer may then be chain-extended with diisocyanates such as isophorone diisocyanate (IPDI) or hexamethylene diisocyanate (HDI), creating a high-density cross-linked film. This network structure may exhibit hydrolytic stability by minimizing ester linkages exposed to aqueous or acidic attack and by maintaining a balanced ratio of hard to soft segments (e.g., 0.3-0.6 hard-segment fraction). During thermal curing, residual isocyanate groups may react with hydroxyl and amine groups within the coating matrix, forming a continuous and chemically resistant film across the dome, sidewall of body 104. In exemplary embodiments, the polyester-urethane network may achieve elongation of 20-60% and a Shore D hardness between 65 and 80, allowing liner 108 to flex with pressure variations in kombucha cans without cracking or delamination. The urethane domains may also suppress micropermeation of carbon dioxide and volatile acids, reducing internal pressure loss and maintaining carbonation stability during extended storage at ambient or elevated temperatures.

With continued reference to FIG. 1, a *Cannabis*-infused beverage embodiment of liner 108 may be configured for formulations containing terpenes, emulsifiers, and in some cases ethanol. In some embodiments, a surface layer of liner 108 may be selected from epoxy-polyester systems with low terpene uptake and reduced swelling in ethanol-containing matrices, and the surface protection layer may employ a fluorinated acrylic modification at low inclusion levels to decrease surface energy and mitigate deposition of surfactant micelles that can compromise local barrier function. In some embodiments, extractables from liner 108 may be controlled below sensory thresholds established for terpene-rich matrices through selection of low-migratory cross-linkers and post-cure regimes. As used herein, "epoxy-polyester system" refers to a hybrid polymer network formed by the co-reaction of epoxy resins (for example, diglycidyl ethers of bisphenol-A or bisphenol-F) with hydroxyl-terminated polyester resins under catalytic or thermal curing conditions. The reaction yields a densely cross-linked matrix that combines the chemical resistance of epoxy domains with the flexibility and adhesion of polyester segments. In such a configuration, the epoxy segments may contribute to low permeability and solvent resistance, while the polyester domains may provide elongation and impact tolerance during can forming and seaming. In some embodiments, the surface layer of liner 108 may employ an epoxy-polyester formulation in which the epoxy-to-polyester ratio ranges between 60:40 and 80:20 by weight, balancing hardness and flexibility for terpene- and ethanol-containing beverages. The network may include latent catalysts such as tertiary amines or imidazoles that activate during curing between 180° C. and 220° C., ensuring complete cross-linking without residual monomers that could migrate into the beverage. The polymer backbone may be modified with pendant aliphatic chains or aromatic rings to tune solubility parameters closer to the polarity of terpene oils, thereby reducing terpene absorption and polymer swelling. To further stabilize the system, a fluorinated acrylic modifier may be incorporated at 0.1-2.0 wt % into the surface protection layer to lower surface energy and limit adsorption of surfactant micelles or emulsifier residues common in *Cannabis*-infused formulations. The fluorinated domains may segregate to the air interface during curing, forming a nanometer-scale fluorine-rich skin that enhances chemical inertness and release properties. In some embodiments, post-cure thermal conditioning or UV treatment may be applied to complete residual cross-linking reactions and minimize extractables, ensuring that volatile organic compounds remain below sensory thresholds defined for terpene-rich beverages.

With continued reference to FIG. 1, in some embodiments, liner 108 may include an adsorptive phase configured to capture trace reactive or odor-active species at the liner-beverage interface. As used herein, an "adsorptive phase" is a microstructured domain embedded within the liner matrix that immobilizes adsorbent materials such as activated carbon, bentonite, or yeast cell wall particulates to trap volatile compounds (e.g., thiols, mercaptans, or aldehydes) without shedding particles or altering beverage composition. In one configuration, the adsorptive phase may include activated carbon dispersed at 0.05-0.5 wt % within the surface layer, forming high-surface-area microdomains that bind reduced sulfur species. Bentonite platelets or yeast cell wall derivatives may be incorporated to capture polar and colloidal impurities, while maintaining liner smoothness and integrity. These immobilized additives may be covalently anchored or physically entrapped within the polymer network to prevent migration into interior volume. In some embodiments, liner 108 may further include a reductive stabilization package comprising ascorbic acid or ascorbate salts (for example, 50-500 ppm equivalent within the functional barrier layer) to scavenge dissolved oxygen and regenerate phenolic radicals. As used herein, a "reductive stabilization package" is a collection of compounds within the liner matrix that chemically neutralize oxidative species and inhibit polymer or beverage oxidation. The ascorbate may be microencapsulated or chemically tethered to prevent leaching while maintaining localized antioxidant activity. A colloidal stabilization component may also be included, comprising food-grade materials such as carboxymethyl cellulose (CMC), potassium polyaspartate (KPA), polyvinylpyrrolidone (PVP), cross-linked polyvinylpolypyrrolidone (PVPP), or yeast cell wall fragments. As used herein, a "colloidal stabilization component" is a group of polymeric or particulate additives configured to suppress haze formation, complex metal ions, and modulate surface fouling at the liner-liquid boundary. These components may function synergistically with metal chelators in the liner to mitigate redox cycling of iron and copper, thereby maintaining clarity and flavor stability during long-term storage. In a representative wine-oriented embodiment, liner 108 may be formulated for a beverage matrix characterized by approximately 2.75 mg/L molecular sulfur dioxide ($SO_2$), 3.1 pH, 43 mg/L free $SO_2$, 11% alcohol by volume (ABV), and 7.8 g/L titratable acidity (TA). Under such conditions, the liner composition may be optimized to (i) attenuate $SO_2$ permeation and conversion to hydrogen sulfide ($H_2S$), (ii) chelate trace copper and iron ions, and (iii) preserve aromatic integrity while preventing under-film corrosion. In this embodiment, the adhesion-promoter sublayer may include 1-3 wt % phosphate-functional coupling agents that anchor the coating to the aluminum oxide surface and suppress corrosion nucleation at the base radius. The functional barrier layer may be formed from a cross-linked epoxy-polyester network with oxygen transmission rates below $10^{-6}$ $cm^3 \cdot cm/(cm^2 \cdot s \cdot Pa)$ at 25° C. and 50% relative humidity. The chelation sites—ranging from 0.1 to 0.3 wt %—may bind free $Cu^{2+}$ and $Fe^{2+}$ ions, thereby reducing catalytic redox cycles responsible for $H_2S$ generation. Sulfur-interactive fillers such as zinc oxide may be incorporated at 0.05-0.2 wt % to immobilize nascent $H_2S$ before it accumulates in the headspace. Meanwhile, fluorinated acrylic modifiers at 0.1-1.0 wt % in the surface protection layer may lower surface energy and prevent adsorption of polar organic acids. Polyvinylpyrrolidone (PVP) and polyvinylpolypyrrolidone (PVPP) domains may transiently complex polyphenols near the interface, dampening radical propagation and protecting sensory compounds such as esters and terpenes. Optionally, activated carbon microdomains may serve as sacrificial traps for residual thiols, preserving varietal aroma. When validated under accelerated aging at 40-45° C., such a liner configuration may demonstrate enamel ratings below 5 mA and impedance ($|Z|_{0.05}$ Hz) above 10 MΩ, with no delamination or blistering after four months, indicating projected storage stability of 12 months or more for the defined beverage chemistry.

With continued reference to FIG. 1, liner 108 may further incorporate an additive package derived from beverage-grade stabilizing agents, each selected for complementary chemical or physical mitigation roles against acidity, oxidation, or sulfur reactivity. In an exemplary formulation, potassium polyaspartate (KPA) may be included at concentrations between 0.05 mL/L and 1.0 mL/L to inhibit tartrate crystallization and promote ionic buffering at the liner-beverage interface. As used herein, "potassium polyaspartate (KPA)" is a polyanionic amino acid polymer effective at chelating divalent cations and modulating electrostatic balance near charged surfaces. Activated carbon may be immobilized at approximately 40 mg/L as a finely divided adsorptive phase to sequester volatile thiols and mercaptans. Cross-linked polyvinylpolypyrrolidone (PVPP) may be dispersed at ≈500 mg/L to complex polyphenolic radicals and suppress oxidative chain reactions initiated by dissolved oxygen. In some embodiments, bentonite at ≈300 mg/L may serve as a layered silicate adsorbent that binds proteins or metal cations before they initiate redox degradation of the liner surface. Carboxymethyl cellulose (CMC), added at ≈0.5 mL/L, may enhance colloidal stability by forming a hydrophilic polymeric layer that regulates ionic transport across the coating boundary. As used herein, "CMC" is a cellulose-derived polysaccharide modified with carboxymethyl groups to improve viscosity control and surface charge distribution within aqueous matrices. Pectinase enzymes may be introduced at ≈2 g/hL (0.02 g/L) as transient clarifying agents in cold-fill operations, where they may remain encapsulated or denature during the liner's curing or pasteurization steps, ensuring no residual enzymatic activity post-filling. Yeast-derived mannoproteins may be included at ≈100 mg/L to stabilize color and aroma by reversible binding of aldehydes and sulfur compounds; as used herein, "mannoprotein" refers to a glycoprotein complex derived from yeast cell walls that provides surface-active properties and metal-binding sites. Ascorbic acid (≈30 mg/L) and ethylenediaminetetraacetic acid (EDTA, ≈25 mg/L) may operate jointly as redox and chelating agents—the former reducing oxygen-driven oxidative stress, and the latter sequestering copper and iron ions that otherwise catalyze hydrogen sulfide formation. This additive suite may be homogeneously distributed or gradient-embedded within liner 108, with immobilization mechanisms (e.g., covalent tethering, ionic cross-linking, or encapsulation) selected to prevent migration into interior volume. The resulting configuration may stabilize acidic beverage compositions—such as a 3.1 pH wine containing 2.75 mg/L molecular $SO_2$, 43 mg/L free $SO_2$, 11% ABV, and 7.8 g/L titratable acidity—by maintaining redox equilibrium, mitigating sulfur conversion, and extending shelf life beyond 12 months under standard storage and distribution conditions.

With continued reference to FIG. 1, body 104 may be selected to cooperate chemically and mechanically with liner 108 for the foregoing beverage classes. In some embodiments, body 104 may include an aluminum alloy from the 3xxx series of aluminum alloys with a chromium-free conversion pretreatment configured to provide a stable oxide for primer sublayer bonding. As used herein, "3xxx series of aluminum alloys," are aluminum-manganese alloys that are non-heat-treatable. In some embodiments, examples of the 3xxx series aluminum alloys may include 3003 (Al—Mn), 3104 (Al—Mn-Mg), and 3004 (Al—Mn-Mg) compositions, each containing approximately 0.8-1.5% manganese and, in some variants, up to 1.2% magnesium to enhance strength and formability. These alloys may provide an optimal balance of drawability and corrosion resistance, making them suitable for beverage can bodies that must maintain mechanical integrity during deep drawing, ironing, and subsequent pressurization cycles. They are known for their moderate strength, excellent corrosion resistance, and good formability. In some embodiments, body 104 surface roughness parameters may be controlled within a window that promotes mechanical interlocking of the primer sublayer without creating peak asperities that increase coating thin-spot risk at the shoulder or flange. In some embodiments, lid 132 may include a complementary liner chemistry formulated to co-deform within double-seam region 122 so that a continuous barrier is formed across seam contact lines under hot-fill or pasteurization conditions.

With continued reference to FIG. 1, body 104 may be enclosed by lid 132, which may be configured to maintain hermetic sealing of interior volume under variable pressure conditions. Lid 132 may include a closure panel and a curl rim that engage flange 128 through a double-seam interface, forming a mechanical and chemical seal. A secondary liner may be deposited on the underside of the closure panel and curl rim prior to assembly so that, when compressed, the secondary liner merges with liner 108 to create a continuous protective barrier across the seam region. As used herein, "secondary liner" is a polymeric coating or gasket. The resulting configuration may isolate the beverage contents from exposure to ambient oxygen and reactive sulfur species, thereby preserving both structural integrity and flavor quality. In some embodiments, the permeability characteristics of the liner materials may be described by oxygen barrier performance, which refers to the steady-state oxygen transmission rate across the liner film. Oxygen barrier performance may be quantified under standard test conditions of 25° C. and 50% relative humidity. In exemplary formulations, the combined liner system may achieve oxygen transmission rates below $10^{-6}$ $cm^3 \cdot cm/(cm^2 \cdot s \cdot Pa)$, providing a superior barrier to oxidative degradation compared to conventional epoxy coatings. During sealing, the double-seam region may plastically deform the interfacing liner layers, forming a conformal joint that maintains barrier continuity through the mechanical compression of polymers. This joint may accommodate cyclic expansion and contraction resulting from pressure and temperature variations, exhibiting elastic recovery that mitigates microcrack formation and prevents oxygen or sulfur ingress during extended storage.

With continued reference to FIG. 1, in some embodiments liner 108 may be applied continuously across the base dome 124 and into the adjoining region of the side wall 120 so that a single, uninterrupted beverage-facing portion of liner 108 covers curvature and strain-concentrated areas. In some embodiments, a thickness profile of liner 108 at the transition between base dome 124 and side wall 120 may be selected to maintain adhesion and continuity during forming, filling, and storage. In some embodiments, liner 108 may also be provided on lid 132, extending over the beverage-facing interior of lid 132. In these embodiments, the chemistry and cure of liner 108 on lid 132 may be chosen to be compatible with liner 108 on body 104 so that the two coated surfaces function cooperatively when lid 132 is joined to body 104. At the connection between lid 132 and body 104, in some embodiments liner 108 on flange 128 may be continued to the cut edge of flange 128, and liner 108 on lid 132 may be continued to the mating region of lid 132, such that coated metal interfaces oppose one another after the closure operation. In some embodiments, relative thicknesses of liner 108 on flange 128 and on lid 132 may be selected to maintain chemical isolation of the underlying metal and to inhibit oxygen and sulfur ingress along the joined region during storage. Across these embodiments, liner 108 on base dome 124, side wall 120, flange 128, and lid 132 may be coordinated so that the beverage-facing portion of liner 108 remains continuous from the lowest point of base dome 124 through side wall 120 and flange 128 to the interior of lid 132, thereby maintaining barrier performance and suppressing degradation throughout the package.

With continued reference to FIG. 1, in some embodiments, body 104 and liner 108 may function as a composite containment system that combines metallic strength with polymeric isolation. The metallic substrate may resist mechanical deformation and maintain can geometry, while the polymeric liner may provide chemical passivation and corrosion protection. When filled with an acidic beverage, variations in pressure or temperature may induce elastic strain within body 104. Liner 108 may accommodate such strain through viscoelastic deformation governed by cross-link density, thereby preventing delamination and maintaining adhesion to the native aluminum oxide surface. The cooperative behavior of these materials may result in an integrated mechanical, chemical, and barrier system that sustains beverage stability throughout its commercial shelf life. Performance metrics may include the prevention of metallic ion migration into the beverage, retention of sensory characteristics such as aroma and color, and maintenance of seam integrity after repeated thermal cycling. Through this combination of structural and chemical design, the apparatus may enable the packaging of highly reactive, acidic beverages—such as wine or kombucha—for periods exceeding twelve months without compromise of product quality or packaging reliability.

With continued reference to FIG. 1, the chemical stability of beverages stored within body 104 may depend not only on liner composition but also on the specific reactive species present in the beverage matrix. For acidic beverages such as rose wine, the presence of molecular sulfur dioxide ($SO_2$) and trace metal ions such as copper can accelerate redox reactions at the liner-beverage interface. Elevated levels of molecular $SO_2$ can catalyze hydrogen sulfide ($H_2S$) formation, leading to sensory defects such as "reductive" or "rotten egg" aromas. However, wines containing less than approximately 1.07 ppm molecular $SO_2$ exhibit no significant $H_2S$ formation after four months of in-can storage when sealed within cans employing liner 108 as described herein. In some embodiments, liner 108 may incorporate sulfur-resistant polymeric materials and embedded scavenger additives that inhibit $SO_2$ and $H_2S$ permeation through its cross-linked matrix. The performance of such systems may depend on the liner's molecular composition and curing chemistry, which determine the density of barrier domains and reactive sites. Liners produced by certain manufacturers.

With continued reference to FIG. 1, maintaining chemical and physical stability within interior volume may depend on both the composition of liner 108 and the controlled parameters of the packaging and filling process. For acidic or sulfur-reactive beverages, it may be critical that the packaged liquid contain no more than approximately 0.2 ppm free copper, as excess copper can catalyze redox reactions leading to hydrogen sulfide generation and subsequent liner degradation. Liner 108 may therefore be formulated to sequester or immobilize trace metal ions through chelating additives or surface-active inhibitors, ensuring that reactive metal concentrations remain below regulatory thresholds during storage. In some embodiments, the packaging process parameters may be selected to preserve the functional integrity of liner 108 and prevent oxidative stress. For example, the beverage may be filled under controlled atmospheres such that dissolved oxygen levels do not exceed 1.2 ppm and total oxygen (including headspace) does not exceed 2.0 ppm. Excess oxygen may otherwise diffuse through the liner matrix, driving oxidative polymer degradation and off-flavor formation. The liner formulation may thus include oxygen scavengers or antioxidant moieties that reinforce the barrier's performance under these oxygen exposure limits. In some embodiments, for a filled and double-seamed container at rest (no agitation) at 70° F., the internal pressure within body 104 may range from about 10-60 psi, accommodating carbonation level, temperature variation, and liquid expansion while avoiding excessive strain at flange 128 and the double-seam. Liner 108 may be engineered with elastic recovery and adhesion properties sufficient to maintain cohesion under cyclic pressure up to 90 psi without blistering or microcracking. As used herein, "elastic recovery" refers to the ability of the cured liner polymer network to deform elastically under mechanical or thermal stress and return substantially to its original dimensions once the stress is released. This property allows liner 108 to accommodate transient expansion and contraction of body 104 caused by carbonation pressure, temperature cycling, or mechanical impact. In exemplary embodiments, elastic recovery may be achieved through controlled cross-link density and the inclusion of flexible polymer segments such as aliphatic polyester or urethane linkages, which distribute stress across the polymer matrix. As used herein, "adhesion properties" refer to the mechanical and chemical bonding strength between liner 108 and the aluminum oxide surface of body 104. Adhesion may be provided by interfacial coupling agents (for example, silanes or phosphates) that covalently link the polymer matrix to the substrate. In some embodiments, adhesion strength may exceed 3 N/mm in peel testing, ensuring that the liner remains bonded under thermal expansion and contraction cycles. For example, during a 24-hour accelerated test cycling between 5° C. and 45° C., a liner with optimized elastic recovery and adhesion properties may maintain a continuous film without visible blistering or delamination, even at high curvature regions near the base radius. These combined characteristics ensure the liner preserves its barrier function and prevents localized electrolyte penetration, thereby maintaining the mechanical and sensory stability of acidic beverages throughout long-term storage. During hot filling operations, temperatures may reach up to 195° F., necessitating that the cross-linked polymer network of liner 108 exhibit thermal stability and adhesion retention under transient heating. For pasteurized or retorted beverages, process water pH may be controlled between 6.5 and 8.0 to avoid hydrolysis of the polymeric coating or corrosion of the metal substrate. Additionally, the fill volume may be maintained within ±2 ml of nominal capacity to prevent localized stress or over-pressurization of body 104 during seaming. These parameters collectively define a thermomechanical and chemical envelope under which the apparatus maintains its integrity and barrier properties. Liner 108 and lid 132 may therefore be formulated and validated to withstand this operational range-supporting internal pressures up to 90 psi, resisting degradation at hot-fill temperatures, and maintaining oxygen and metal reactivity below the critical limits necessary to ensure long-term product stability and sensory quality.

With continued reference to FIG. 1, the resistance of liner 108 to degradation at hot-fill temperatures may be achieved through both polymer network design and thermal-mechanical stabilization mechanisms. In some embodiments, the cross-linked polymer backbone of liner 108 may include aromatic epoxy, polyester-urethane, or novolac-based segments with high glass-transition temperatures (Tg ≥160° C.). These resins may be selected for their ability to retain cohesive strength and barrier integrity at process temperatures up to 195° F. (≈90° C.) during hot-fill operations. The liner may further include a heat-stabilizing additive package containing hindered phenolic antioxidants and phosphorus-based radical scavengers, which suppress oxidative chain scission at elevated temperature. A secondary stabilizer, such as benzotriazole or triazine UV absorbers, may prevent photothermal degradation when cans are exposed to transient high-intensity light during pasteurization or storage. Adhesion at the metal interface may be reinforced by organophosphate coupling agents that chemically bond to the hydrated aluminum oxide surface and remain stable above 200° C., preventing under-film debonding during thermal expansion. In certain embodiments, the surface protection layer of liner 108 may include ceramic or silica nanoparticle fillers dispersed in the polymer matrix to inhibit localized softening and blister initiation under transient vapor pressure. For example, when subjected to a hot-fill simulation at 190° F. for 60 seconds followed by rapid quenching, an optimized liner may maintain adhesion exceeding 90% of baseline peel strength and exhibit no measurable increase in oxygen transmission rate. This thermal-resilient configuration allows the composite system of body 104 and liner 108 to preserve barrier integrity, color stability, and organoleptic quality even in high-temperature beverage-processing environments.

With continued reference to FIG. 1, In one or more embodiments, container 100 includes metallic body 104 lined with a specialized, BPA-free epoxy or polymeric liner 108 engineered for reactive beverages (e.g., wine, kombucha, *Cannabis*-infused drinks) having low pH and volatile sulfur compounds. In these embodiments, liner 108 may include chemistries and/or multilayer architectures that resist acid-driven under-film corrosion, mitigate sulfur interactions (e.g., $H_2S/SO_2$-related off-aromas), and provide enhanced oxygen-barrier performance to limit oxidative degradation. In some embodiments, process controls on film thickness, curing, and coverage at stress points (e.g., dome and lip) may be selected to reduce delamination, blistering, and pinhole formation. Advantageously, the disclosed embodiments may preserve sensory stability (e.g., prevention of metallic or sulfur faults) and structural integrity over extended shelf lives (e.g., about 12-24 months or longer), as validated by accelerated aging and gas-evolution testing. Compared with conventional epoxy/acrylic liners designed for beer or soft drinks, the disclosed embodiments may deliver improved corrosion resistance under acidic/sulfur-rich conditions, tighter variability control across formed features, and more robust performance across distribution and elevated-temperature storage.

FIGS. 2-22, as discussed further below, disclose a series of analytical studies and validation experiments to characterize and verify performance of body 104 and liner 108 when used with acidic and sulfur-containing beverages. In some embodiments, these figures may present (i) sampling and specimen-preparation workflows for spatially resolved examination of the can interior, (ii) spectroscopic and optical methods that identify liner chemistry and quantify coating thickness and uniformity, (iii) electrochemical and enamel-rating assessments that evaluate barrier continuity and porosity, and (iv) accelerated-aging assays that measure hydrogen sulfide ($H_2S$) evolution as a function of beverage chemistry, liner composition, and manufacturing source.

Figure 2:
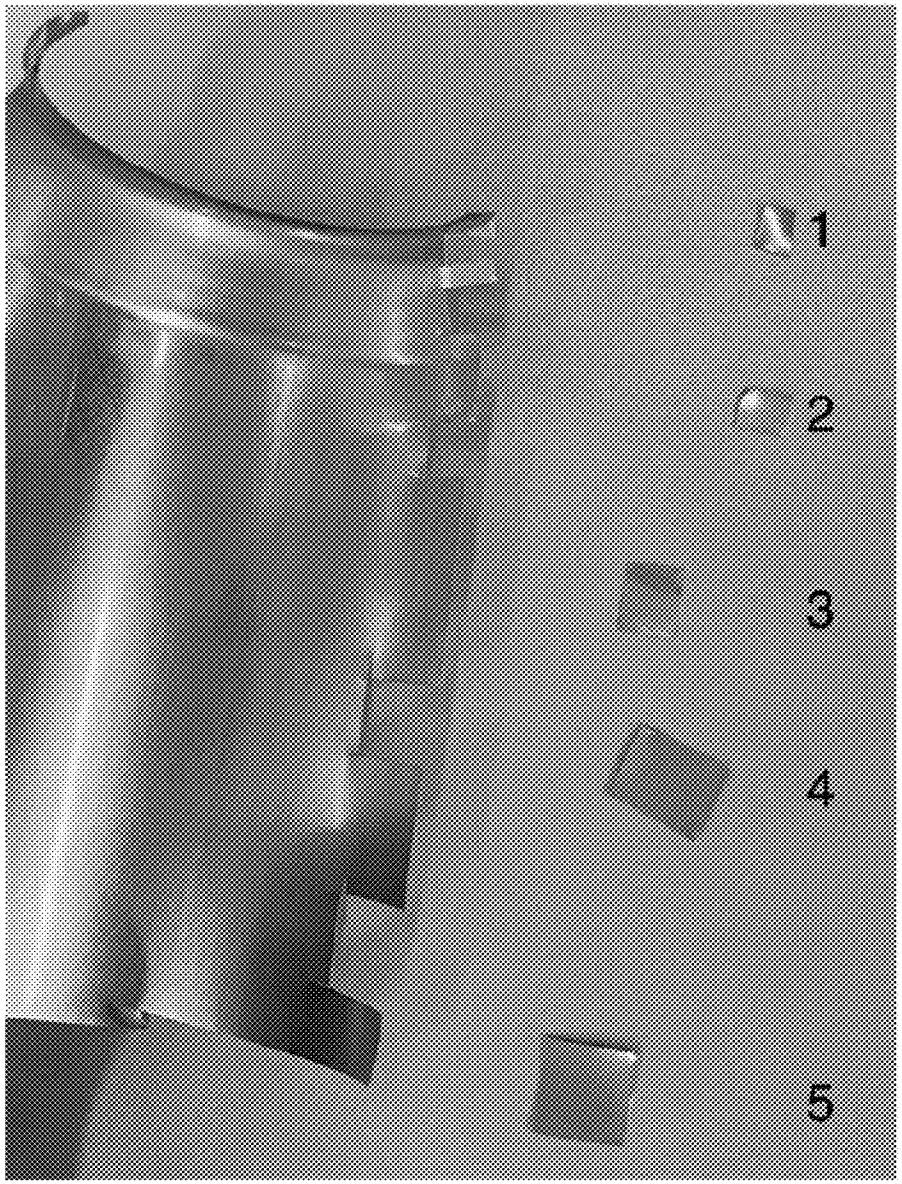
FIG. 2 illustrates the location within a can body sampled for liner and aluminum surface analysis.

Now referring to FIG. 2, illustrates the location within a can body sampled for liner and aluminum surface analysis. In an embodiment, a polymeric liner and aluminum interior surface of cans used in long-term storage trials (e.g., X1, Y2, and Z2) may be evaluated both prior to and following storage using a combination of optical, spectroscopic, and compositional analysis techniques. In some embodiments, unlined aluminum cans provided by manufacturers may also be analyzed to establish baseline elemental and morphological profiles for comparison.

In an exemplary embodiment, can samples may be prepared for analysis by first sectioning the cylindrical body of each can using a precision cutting instrument such as a Gryphon C-40 band saw (Gryphon Corporation). Each sectioned can may then be vertically cut with stainless steel shears to open the body into a flat rectangular sheet, following the procedure previously described for coupon preparation. For post-storage analysis, the can lid may be removed using a mechanical seam teardown tool (e.g., Oktober Design) to prevent liner tearing and to maintain sample integrity. From each can, multiple test specimens may be obtained from five distinct vertical regions, ranging from the base to the upper headspace region, as illustrated in FIG. 2. In an embodiment, coupons for surface analysis may be approximately 0.25 cm×0.25 cm in size, except for coupons collected from headspace regions where spatial constraints may require smaller samples (approximately 0.25 cm×0.1 cm). These smaller coupons may enable accurate assessment of liner uniformity and corrosion signatures at the curved transition zone near the lid seam. Prior to analysis, sample surfaces may be gently cleaned with inert gas to remove loose particulate matter, ensuring that no additional abrasion or polishing alters the native liner morphology.

In some embodiments, elemental composition of both unused bare aluminum and pre- and post-storage lined can samples may be determined using x-ray fluorescence (XRF) spectroscopy. For purposes of this disclosure, "x-ray fluorescence (XRF)" refers to a non-destructive analytical method in which incident x-rays excite core electrons within a sample, causing emission of characteristic secondary radiation that can be used to quantify elemental composition. In an exemplary implementation, samples approximately 1 cm×1 cm (obtained from FIG. 2, Location 4) may be analyzed using a portable XRF spectrometer (e.g., Bruker Tracer III-SD). Each measurement may be conducted in triplicate, with the excitation voltage set to approximately 40 kV, the tube current set to approximately 40 μA, and a dwell time of approximately 60 seconds per scan.

In one embodiment, the portable XRF unit may be operated in an upward-facing tabletop geometry, allowing samples to be positioned directly on the measurement window with the inner surface of the can facing the detector aperture. Spectral data may be collected under ambient laboratory conditions and analyzed using spectral-fitting software such as PyMCA to quantify element-specific peak areas. In some embodiments, the resulting spectra may be used to determine the presence and concentration of key alloy components (e.g., aluminum, magnesium, manganese, and iron) as well as trace elements indicative of liner degradation or beverage-induced corrosion (e.g., tin, copper, zinc, or sulfur residues). In further embodiments, XRF compositional profiles obtained before and after storage may be compared to identify changes in elemental abundance correlated with beverage exposure. Such comparative analysis may reveal evidence of liner delamination, diffusion of metallic ions through the coating, or loss of protective barrier components.

With continued reference to FIG. 2, in some embodiments, the composition and physical characteristics of the can liner and underlying aluminum substrate may be characterized using a combination of spectroscopic, optical, and electrochemical measurement techniques. These methods may be applied both to pre-storage and post-storage samples to assess liner degradation, compositional changes, adhesion integrity, and metal exposure. In an exemplary implementation, analysis may be performed on lined aluminum beverage cans of types X1, Y2, and Z2, as well as unlined aluminum control samples provided by the manufacturer.

In some embodiments, Fourier transform infrared-attenuated total reflectance (FTIR-ATR) spectroscopy may be employed to characterize the chemical composition of polymeric liner materials. For purposes of this disclosure, "FTIR-ATR" refers to a spectroscopic technique in which infrared radiation is directed through an optically transparent crystal at a shallow angle to induce total internal reflection, allowing the evanescent field to interact with the liner surface and yield absorbance spectra representative of molecular functional groups. In one embodiment, spectra may be collected using a Bruker Vertex V80V Vacuum FTIR system operated under a nitrogen atmosphere (Cornell Center for Materials Research, Ithaca, NY). Coupons approximately 0.5 cm×0.5 cm in size may be prepared in triplicate from the mid-body region of each can (corresponding to FIG. 2, Location 4). Spectral data may be collected across a wavelength range of approximately 4000 to 700 $cm^{1}$. In some embodiments, the acquired FTIR-ATR spectra may be analyzed to identify characteristic absorbance bands corresponding to epoxy, polyester, or acrylic resin constituents, thereby confirming liner composition and detecting chemical shifts associated with beverage exposure or oxidation.

In some embodiments, liner thickness and aluminum surface uniformity may be profiled using laser-scanning profilometry. For purposes of this disclosure, "laser-scanning profilometry" refers to a non-contact optical method that reconstructs a three-dimensional surface topography by measuring the reflected intensity of a focused laser beam scanned across a defined area. In an exemplary embodiment, measurements may be conducted using a Keyence VK-X260 laser-scanning profilometer at a laser wavelength of approximately 408 nm. Each sample may be analyzed using the "surface profile" mode to evaluate substrate smoothness and the "thin film" mode to determine liner coating thickness and uniformity. A refractive index of approximately 1.7 may be applied for BPA and BPA-NI epoxy liners, extrapolated from the known polycarbonate refractive index in the 435-1052 nm range. The measured field of view may be approximately 285 μm×210 μm, allowing micro-scale visualization of coating uniformity and potential micro-defects.

In some embodiments, liner thickness in both the body and dome regions of cans may additionally be determined using optical interferometry. For purposes of this disclosure, "optical interferometry" refers to a precision technique that measures film thickness by analyzing interference patterns produced by the reflection of broadband light from layered surfaces. In an exemplary embodiment, an interferometric film-thickness analyzer (e.g., SpecMetrix ACS-10, Sensory Analytics LLC) may be used across a spectral range of approximately 700-1400 nm, with a refractive index of approximately 1.55 applied for computational modeling. Three cans of each liner type may be sampled, and data may be used to quantify mean liner thickness, inter-sample variation, and coating distribution between structural regions of the can. In further embodiments, electrochemical impedance spectroscopy (EIS) may be employed to evaluate liner integrity, including the presence of pores, coating continuity, and barrier performance. For purposes of this disclosure, "EIS" refers to an electrochemical measurement technique in which a sinusoidal voltage perturbation is applied to a sample immersed in an electrolyte, and the resulting current response is analyzed to determine impedance characteristics over a range of frequencies. In an exemplary configuration, EIS measurements may be conducted in triplicate using a PalmSens3 potentiostat with PSTrace 5.9 software. Intact, unused lined cans may be analyzed directly (rather than isolated coupons) following established protocols. The experimental setup, shown in FIG. 16, may include a working electrode in contact with the exterior can bottom, a counter electrode consisting of a flat steel cell, and a silver/silver chloride (Ag/AgCl) reference electrode immersed in a 35 g/L sodium chloride (NaCl) electrolyte solution. The system may be housed within a Faraday cage to prevent electromagnetic interference. The open circuit potential (OCP) may be stabilized prior to measurement (drift <0.01 mV/sec).

In some embodiments, metal exposure measurements may be performed using an enamel rater (e.g., WACO Enamel Rater III). For purposes of this disclosure, an "enamel rater" is an industry-standard instrument configured to measure coating porosity by quantifying current flow through exposed metal regions under an applied voltage. In an exemplary test, cans may be filled with a 10 g/L NaCl electrolyte solution to a standardized level, and a stainless-steel probe electrode may be immersed within the can. A potential of approximately 6.3 V may be applied for four seconds, after which the resulting current may be recorded. The measured current may provide a quantitative indication of liner coverage, with higher current values corresponding to greater exposed metal area. Three cans of each type from the long-term storage study may be analyzed to compare coating integrity across liner chemistries. In some embodiments, liner adhesion quality may be evaluated using standardized mechanical testing. For example, adhesion testing may be performed in accordance with ASTM D3359-17, Test Method B. For purposes of this disclosure, "liner adhesion quality" refers to the mechanical robustness of the liner-to-substrate bond under applied shear or peel stress. In an exemplary test, six parallel horizontal and six parallel vertical incisions may be made on the interior can surface using a precision cutting tool to form a crosshatch pattern. A pressure-sensitive adhesive tape (e.g., Scotch Bi-Directional Filament Tape 8959, 1800 peel strength of approximately 11 N/cm) may then be applied to the incised area. After 90 seconds of dwell time, the tape may be peeled off and the percentage of removed coating area may be quantified, providing a measure of liner adhesion strength. In additional embodiments, the presence of uncoated or exposed metal regions may be evaluated qualitatively using the ASBC Can Method 8. For purposes of this disclosure, "uncoated region detection" refers to the identification of areas where the liner coating is absent or discontinuous, exposing the aluminum substrate. In an exemplary test, an aqueous solution containing hydrochloric acid (0.027 N) and copper sulfate pentahydrate (100 g/L) may be added to cans (n=3 replicates) and maintained at room temperature for approximately 45 minutes. Uncoated regions may be visually identified by the formation of copper deposits on exposed aluminum areas, indicating liner discontinuity or manufacturing defects.

Figure 3:
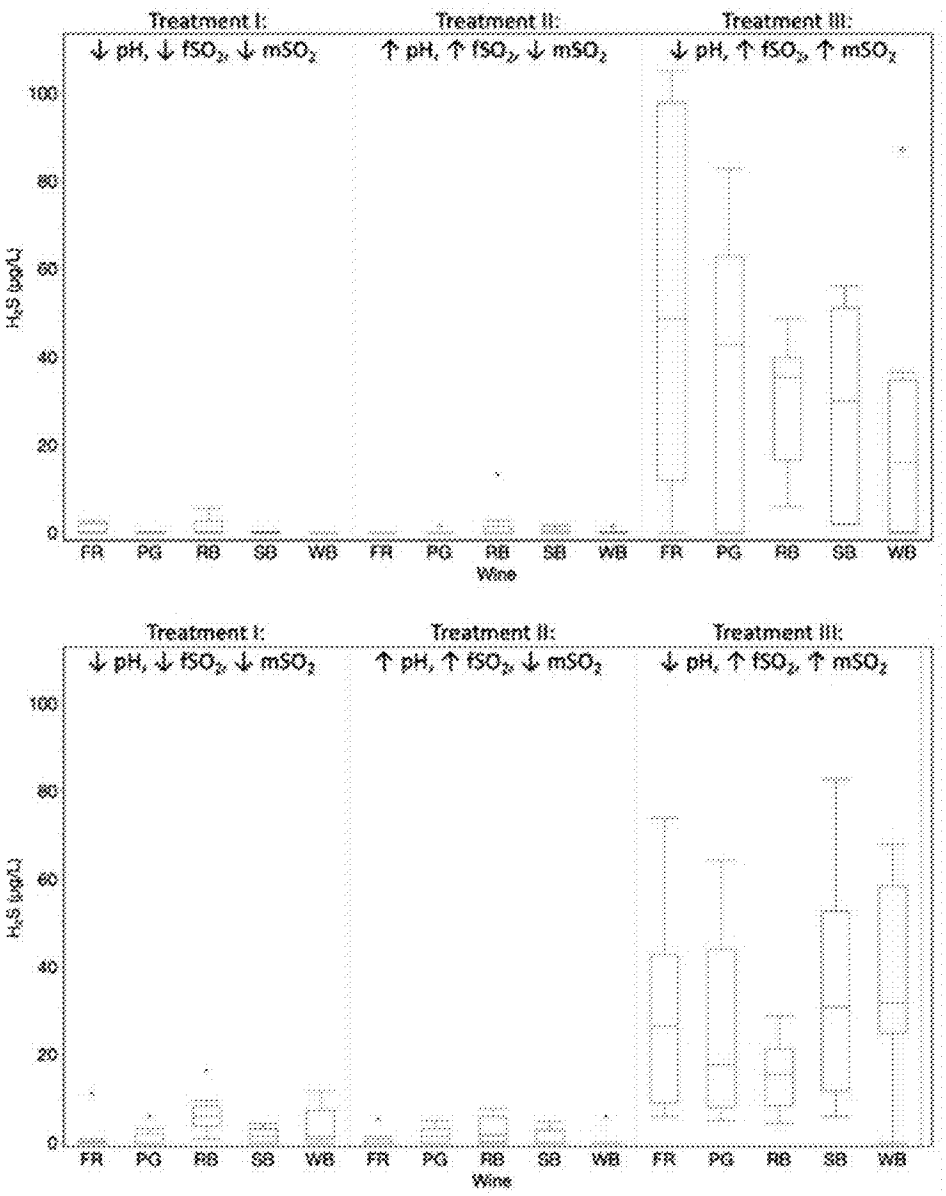
FIG. 3 is a graphical representation of hydrogen sulfide ($H_2S$) production by treatment group and wine after four months (top) and eight months (bottom)

With reference now to FIG. 3, a graphical representation of hydrogen sulfide ($H_2S$) production by treatment group and wine after four months (top) and eight months (bottom) is illustrated. In some embodiments, empirical results from long-term storage trials demonstrate that hydrogen sulfide ($H_2S$) accumulation in canned wines varies as a function of liner composition, wine chemistry, and molecular sulfur dioxide ($SO_2$) concentration. Earlier investigations involving isolated aluminum coupons and single wine formulations suggested that $H_2S$ formation was elevated in acrylic-lined cans relative to epoxy-lined cans, and that molecular $SO_2$ was a stronger predictor of $H_2S$ generation than either free $SO_2$ or pH alone. However, those prior studies were limited to short-term accelerated conditions and single-source liners. The present disclosure extends those findings by evaluating multiple commercial wine types and multiple liner sources under extended storage conditions, thereby confirming and refining the relationship between wine chemistry and gas evolution in sealed aluminum containers.

In an exemplary embodiment, five commercial wines, Pinot Grigio, Sauvignon Blanc, French Rose, Sparkling Rose, and Sparkling White, were each adjusted to yield three distinct treatment groups characterized by varying combinations of pH, free $SO_2$, and molecular $SO_2$ levels. Specifically, Treatment I represented low-pH, low-free-$SO_2$, and low-molecular-$SO_2$ conditions; Treatment II represented high-pH, high-free-$SO_2$, and low-molecular-$SO_2$ conditions; and Treatment III represented low-pH, high-free-$SO_2$, and high-molecular-$SO_2$ conditions. Additional theoretical combinations could not be produced due to the dependent relationship between molecular $SO_2$ and hydrogen ion concentration, as molecular $SO_2$ is a function of both free $SO_2$ and [H]. The "high" molecular $SO_2$ range tested (approximately 1.6-2.6 mg/L) may correspond to approximately 0.8-2.0 mg/L when expressed under conventional water-based dissociation constants, given ethanol-adjusted pKa correction factors. In some embodiments, wines corresponding to each treatment may be sealed in cans from three commercial suppliers, designated $X_1$(BPA-epoxy), $Y_2$ (BPA-NI epoxy), and $Z_2$ (BPA-NI epoxy), and stored under controlled conditions at approximately 20° C. for extended durations. Hydrogen sulfide levels may then be quantified at predetermined intervals (e.g., four and eight months) as depicted in FIG. 3.

In one embodiment, the unadjusted Treatment I wines exhibited non-detectable or trace $H_2S$ concentrations (<3 μg/L) immediately following canning, with mean values below the sensory threshold (<10 μg/L) at both the four- and eight-month timepoints. In contrast, adjusted wines in Treatment III (high molecular $SO_2$) produced significantly higher $H_2S$ concentrations than Treatment I or II wines (analysis of variance, $p<0.05$). After four months of storage, the average $H_2S$ concentration in Treatment III samples was approximately 28.7 μg/L, with some samples exceeding 100 μg/L. By comparison, Treatments I and II averaged approximately 2.2 μg/L over the same interval. After eight months, similar trends were observed, as illustrated in FIG. 3 (bottom), wherein Treatment III wines maintained the highest $H_2S$ accumulation, indicating that elevated molecular $SO_2$, rather than free $SO_2$ concentration alone, remains a principal driver of $H_2S$ formation under long-term storage conditions. The measured $H_2S$ concentrations in these treatments, particularly for Treatment III, substantially exceeded levels previously observed in bottled wines (≤6 μg/L) and surpassed typical sensory detection thresholds (~1 μg/L).

Without being bound by theory, it is believed that the neutral molecular $SO_2$ fraction may permeate the non-polar liner interface and undergo chemical reduction upon contact with the aluminum substrate, leading to $H_2S$ formation and potential liner degradation. Because molecular $SO_2$ represents a component of total free $SO_2$ and its relative abundance increases at lower pH, the observed effect likely reflects an interactive relationship between $SO_2$ speciation and acidity rather than an independent molecular $SO_2$ mechanism. No statistically significant correlations were observed between $H_2S$ accumulation and other compositional parameters, including alcohol content, titratable acidity, dissolved aluminum, or residual sugar, as summarized in FIG. 10 ($p>0.05$, one-way ANOVA for all factors). These findings collectively confirm that (i) molecular $SO_2$ exerts the dominant influence on $H_2S$ generation during long-term aluminum can storage, (ii) liner chemistry modulates the rate and extent of gas evolution, and (iii) compositional parameters not associated with $SO_2$ speciation contribute minimally under the tested conditions.

Figure 4:
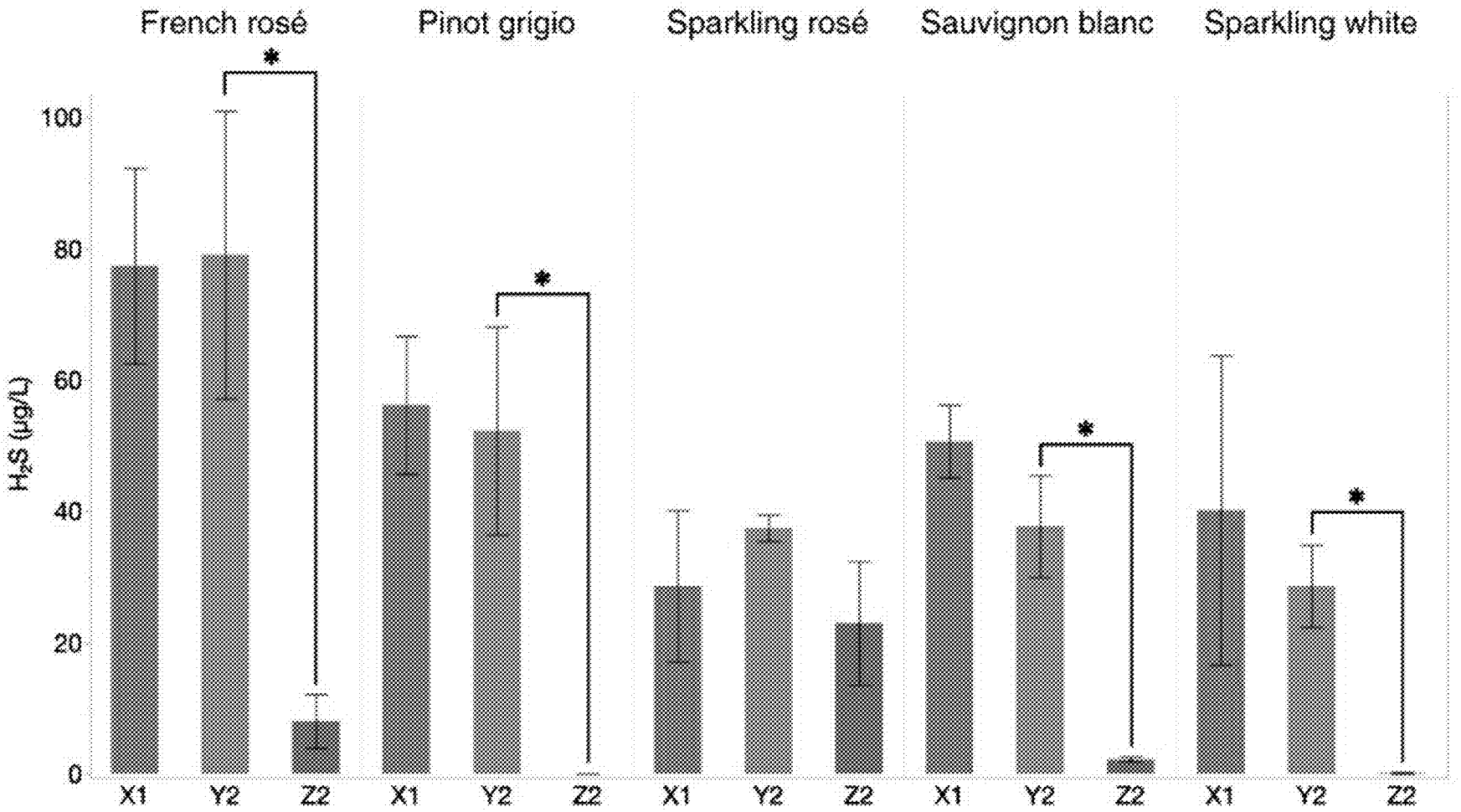
FIG. 4 is a graphical representation of hydrogen sulfide ($H_2S$) production by liner (X1, Y2, and Z2) for each of five Treatment III wines after four months of storage.

With reference now to FIG. 4, a graphical representation of hydrogen sulfide ($H_2S$) production by liner (X1, Y2, and Z2) for each of the five Treatment III (high molecular $SO_2$) wines after four months of storage is illustrated. In some embodiments, the long-term storage data may further be analyzed to evaluate liner-specific effects on hydrogen sulfide ($H_2S$) production across different wine compositions. The results for wines corresponding to Treatment III (high molecular $SO_2$ conditions) stored in three different liner types are illustrated in FIG. 4. In one embodiment, cans designated $Z_2$ (BPA-NI epoxy) exhibited markedly lower mean $H_2S$ concentrations (approximately 5.9 μg/L±2.1) compared to cans designated $X_1$ (BPA epoxy) and $Y_2$ (BPA-NI epoxy) (mean=36.6 μg/L±3.2; two-way ANOVA, $p<0.05$). These data indicate that, even within similar chemical liner classes, manufacturer-specific implementation variables may contribute substantially to corrosion-driven sulfur gas evolution.

In some embodiments, the observed differences between $Y_2$ and $Z_2$ cans may be attributed to manufacturing variability, despite the reported use of an identical liner formulation (e.g., Valspar V70 BPA-NI epoxy). Such variability may include differences in polymer cross-linking, cure kinetics, or application thickness, all of which may influence the permeability of the liner to reactive sulfur species and the local electrochemical environment at the metal-liner interface. Notably, $Z_2$ cans also produced less $H_2S$ than $X_1$ cans, even though $X_1$ utilized a conventional BPA-epoxy liner traditionally considered the industry "gold standard." Statistical variance analysis (Levene's test, $p<0.05$) demonstrated that $Z_2$ cans not only yielded lower mean $H_2S$ concentrations but also exhibited significantly lower inter-replicate variance compared to either $X_1$ or $Y_2$ cans. Reduced variance may indicate greater liner application consistency or enhanced uniformity of the coating thickness across can surfaces, suggesting that manufacturing process control exerts a measurable influence on the reproducibility of chemical stability outcomes.

In prior literature, variation in $H_2S$ production among canned wines has often been high (relative standard deviation exceeding 50%), even when cans were sourced from a single manufacturer. The present findings suggest that can-to-can variability, potentially arising from fluctuations in liner deposition thickness, adhesion, or cure temperature, may represent a significant unaccounted factor influencing gas formation rates. Such variability has been similarly implicated in beverage-can corrosion studies.

In certain implementations, the time-dependent trend observed in the low-$SO_2$ control wines (Treatment I) may further corroborate liner influence. Specifically, cans designated $X_1$ produced the highest $H_2S$ concentrations in Treatment I control samples (ANOVA, $p=0.029$; data not shown), with incremental increases in $H_2S$ from four to eight months of storage. This pattern suggests that even under low-reactivity conditions, liner chemistry and manufacturing quality may contribute to baseline $H_2S$ accumulation rates. Accordingly, the data depicted in FIG. 4 collectively demonstrate that liner-to-liner and manufacturer-to-manufacturer variations have a statistically significant effect on $H_2S$ formation kinetics.

Figure 5:
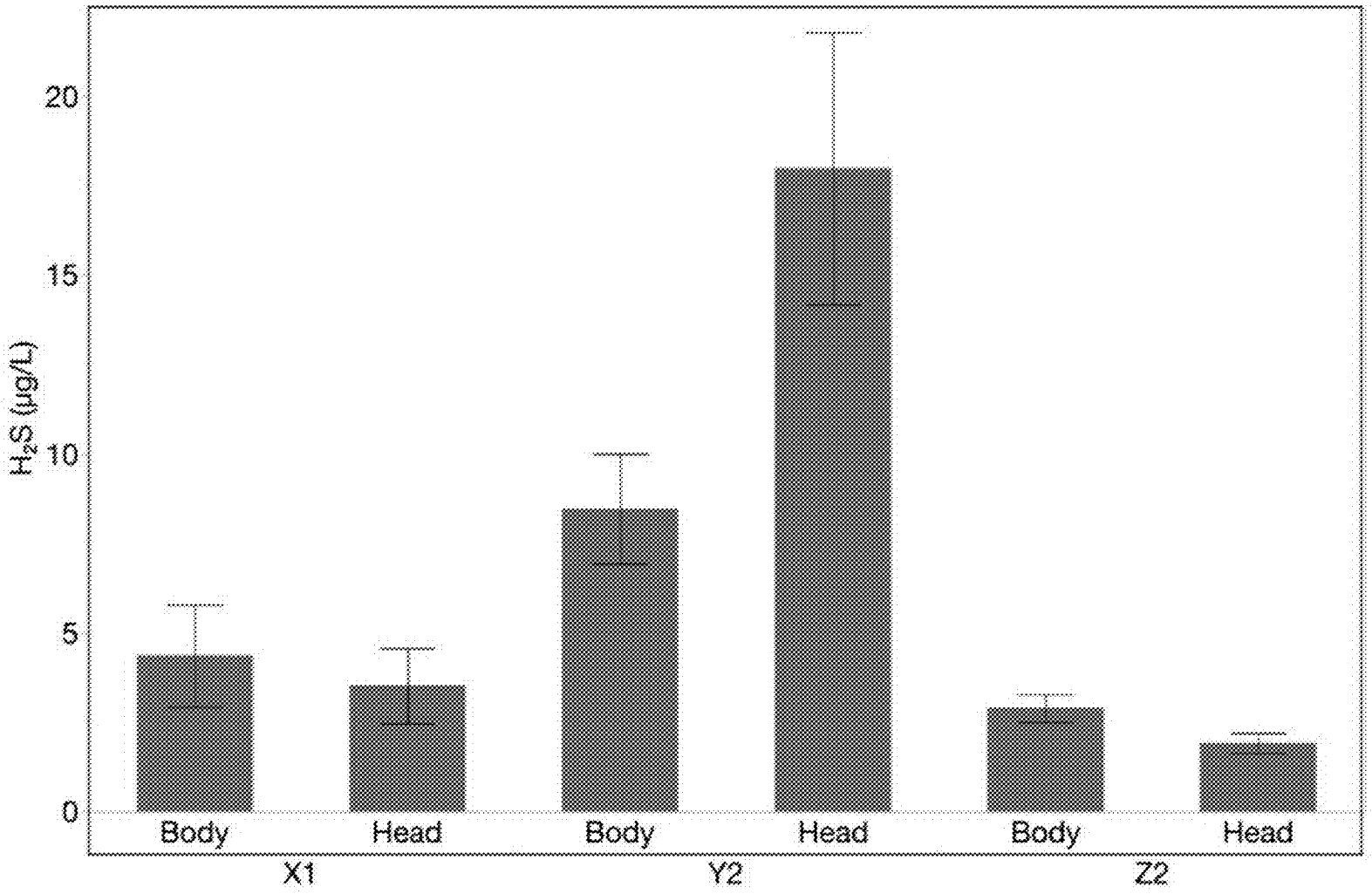
FIG. 5 is a graphical representation of hydrogen sulfide ($H_2S$) production from a can body and headspace coupons from three different batches of cans (X1, Y2, Z2), using the accelerated aging assay in triplicate, measuring at three and 14 days of storage.

With reference now to FIG. 5, a graphical representation of hydrogen sulfide ($H_2S$) production from can body (see FIG. 2, Location 4) and headspace (see FIG. 2, Locations 1 and 2) coupons from three different batches of cans (X1, Y2, Z2), using the accelerated aging assay in triplicate (technical replicates), measuring at three and 14 days of storage is illustrated. in some embodiments, accelerated corrosion and hydrogen sulfide ($H_2S$) formation may vary between distinct structural regions of an aluminum beverage can. Prior studies have indicated that cans exhibiting higher $H_2S$ accumulation during long-term storage also display greater visible corrosion, suggesting a correlation between gas evolution and liner degradation. Although visible corrosion was not quantitatively scored in the present investigation, qualitative observations revealed region-specific variation among can sources. For example, cans designated $X_1$ exhibited visible corrosion predominantly along the body wall, whereas cans designated $Y_2$ exhibited corrosion concentrated near the upper neck and headspace region (see FIG. 17).

To evaluate whether such spatial differences reflect variable susceptibility to corrosion, coupons were prepared from the headspace neck region (corresponding to FIG. 2, Locations 1 and 2) and from the body sidewalls (corresponding to FIG. 2, Location 4). The coupons were incubated in a commercial Riesling wine under accelerated aging conditions (approximately three days at 50° C.). As illustrated in FIG. 5, $H_2S$ formation was greatest for the headspace-region coupons of the $Y_2$ can type, producing approximately three-fold higher $H_2S$ concentrations than coupons sourced from the can body. This observation is consistent with the visually evident corrosion near the upper neck region of the $Y_2$ cans.

Without being bound by theory, it is believed that regional differences in liner adhesion, coating thickness, or local curing temperature during manufacture may contribute to the observed heterogeneity in corrosion resistance. However, given that the total surface area of the can body is an order of magnitude greater than that of the neck region, localized corrosion alone is unlikely to account for global differences in $H_2S$ accumulation across liner types or manufacturers. Accordingly, liner uniformity and chemical barrier quality remain more predictive factors for system-wide compatibility assessment.

Figure 6:
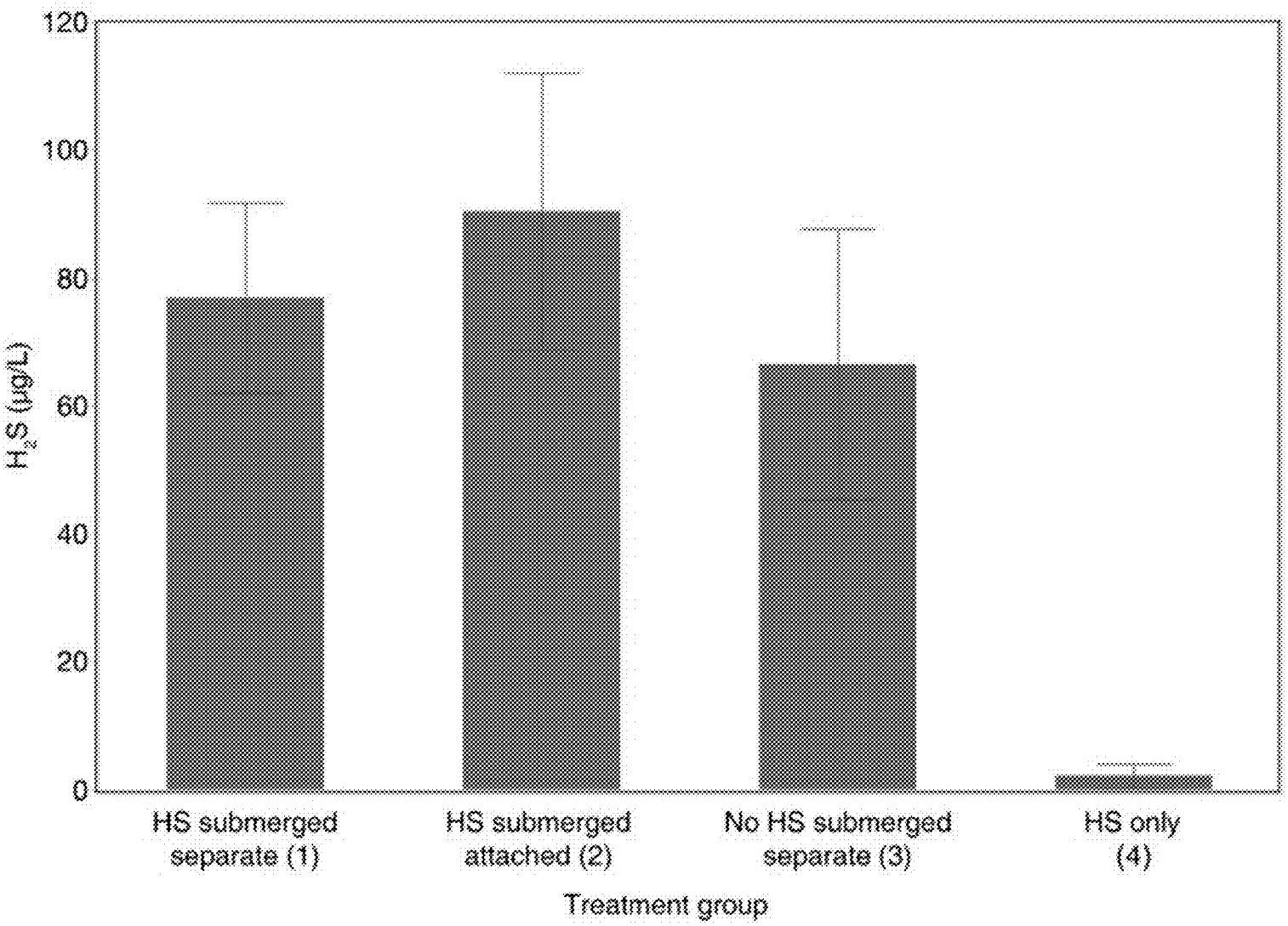
FIG. 6 is a graphical representation of dependence of hydrogen sulfide ($H_2S$) formation on location of coated aluminum coupon.

Referring now to FIG. 6, a graphical representation of dependence of hydrogen sulfide ($H_2S$) formation on location of coated aluminum coupon (headspace [HS] versus immersed) is illustrated. Treatment 1, two coupons, one in headspace and one immersed; Treatment 2, one intact coupon, partially in headspace and partially immersed; Treatment 3, two coupons, both immersed; and Treatment 4, coupon in HS only is illustrated. To further examine whether corrosion and $H_2S$ production differ between immersed and non-immersed aluminum regions, an additional accelerated aging protocol was conducted wherein the spatial orientation of aluminum coupons was systematically varied. As shown in FIG. 6, negligible $H_2S$ formation occurred when aluminum was present exclusively in the headspace (non-immersed), indicating that generation of $H_2S$ through the reduction of $SO_2$ requires direct liquid contact. Similarly, no statistically significant increase in $H_2S$ concentration or visible corrosion was detected when comparing fully immersed coupons (Treatment III) to partially immersed coupons (Treatments I and II), demonstrating that immersion depth alone does not materially affect reaction kinetics under these conditions. Accordingly, the higher corrosion observed in the neck region of certain liners (e.g., Y2) is attributed to reduced coating integrity or localized barrier defects rather than to increased chemical reactivity in vapor-phase regions.

Figure 7:
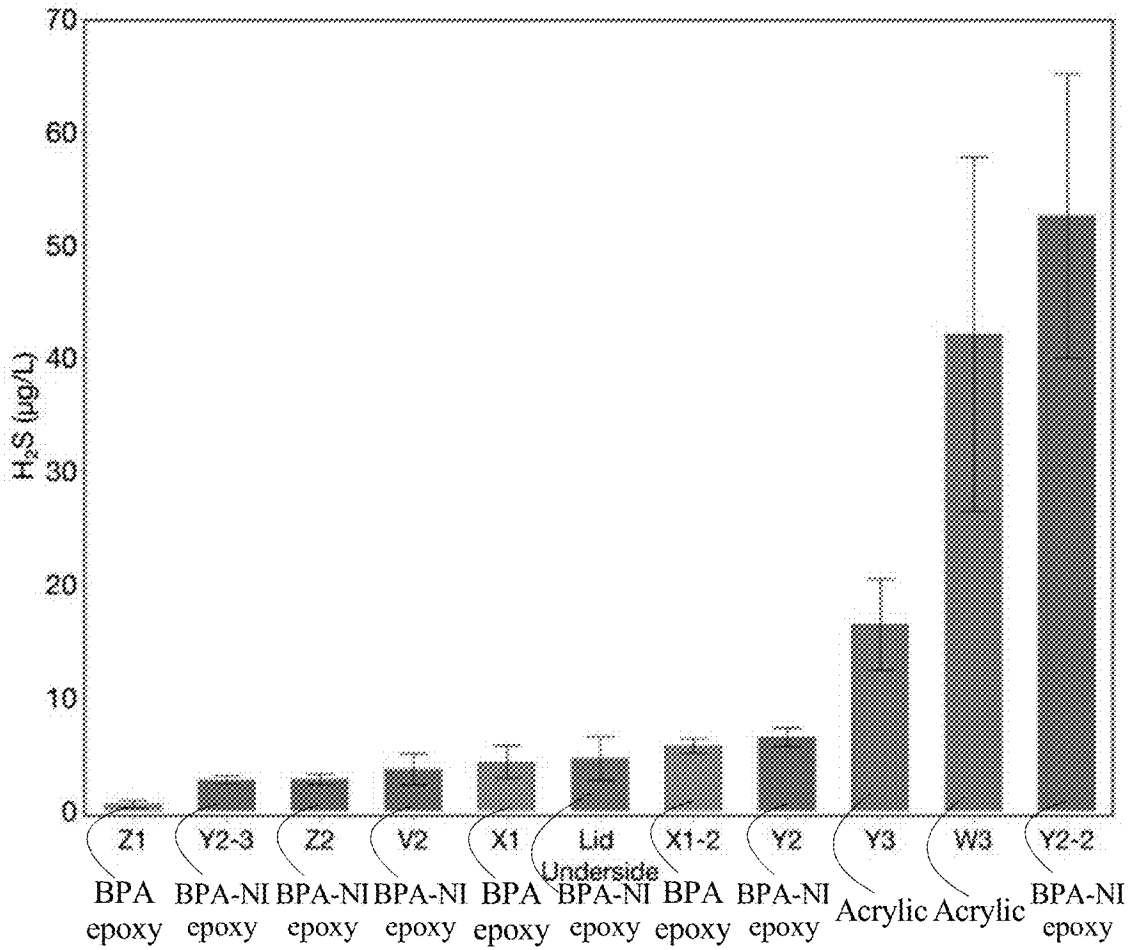
FIG. 7 is a graphical representation of hydrogen sulfide ($H_2S$) production for 10 different can types, as well as the underside of the can lid, after three days in accelerated aging conditions with a commercial German Riesling.

With reference now to FIG. 7, a graphical representation of hydrogen sulfide ($H_2S$) production for 10 different can types, as well as the underside of the can lid, after three days in accelerated aging conditions with a commercial German Riesling is illustrated. In some embodiments, accelerated aging trials may be conducted to further evaluate hydrogen sulfide ($H_2S$) formation across a plurality of liner types and can manufacturers. The accelerated aging protocol may allow controlled evaluation of corrosion-driven gas evolution independent of long-term storage variables such as temperature cycling, light exposure, or headspace gas exchange. In one embodiment, coupons were prepared from cans used in the long-term study described above, designated X1, Y2, and Z2, together with coupons from seven additional liner treatments, yielding a total of ten test configurations. Each coupon was incubated in a single commercially available German Riesling characterized by a high molecular $SO_2$ concentration, thereby standardizing the beverage chemistry across all test groups.

As illustrated in FIG. 7, in some embodiments, $H_2S$ formation under accelerated conditions may vary significantly among liner compositions and manufacturing sources. Consistent with previous findings, acrylic-coated coupons generated substantially higher $H_2S$ concentrations, up to approximately 100 μg/L, than other liner types, with the exception of the $Y_2$-2 batch (Tukey test, $p<0.05$). By comparison, epoxy and BPA-NI epoxy liners generally exhibited lower $H_2S$ generation, reinforcing the observed correlation between polymer chemistry and corrosion protection performance.

In certain embodiments, variation in $H_2S$ formation may also be detected among different manufacturers producing liners nominally classified under the same polymer category. For example, coupons corresponding to Z2 generated significantly lower $H_2S$ concentrations than all three Y2 batches (ANOVA, $p<0.05$), and coupons corresponding to Z1 generated lower concentrations than X1 (ANOVA, $p<0.05$). These findings demonstrate that liner formulation alone is not predictive of stability outcomes, and that manufacturing variables such as curing conditions, cross-linking density, and surface uniformity can produce measurable chemical divergence even when nominal liner chemistries are identical. Similar inter-manufacturer variability was observed among acrylic coatings sourced from different producers (e.g., Y3 and W3), which exhibited statistically distinct mean $H_2S$ values and elevated within-group variance (Levene's test, $p<0.05$). This result suggests that polymer homogeneity and process consistency during liner deposition materially affect barrier integrity and gas evolution behavior. Batch-to-batch variation was also observed among cans designated Y2, wherein the defective lot Y2-2 produced approximately ten-fold higher $H_2S$ than either the original batch (Y2) or thinner-coated variant (Y2-3). The visually defective Y2-2 cans displayed surface irregularities and incomplete coating in the moat region (see FIG. 18), which likely contributed to elevated reactivity and reduced corrosion resistance. These results confirm that localized liner defects, particularly in high-stress forming regions of the can, can amplify reductive gas generation independent of overall polymer chemistry.

Figure 8:
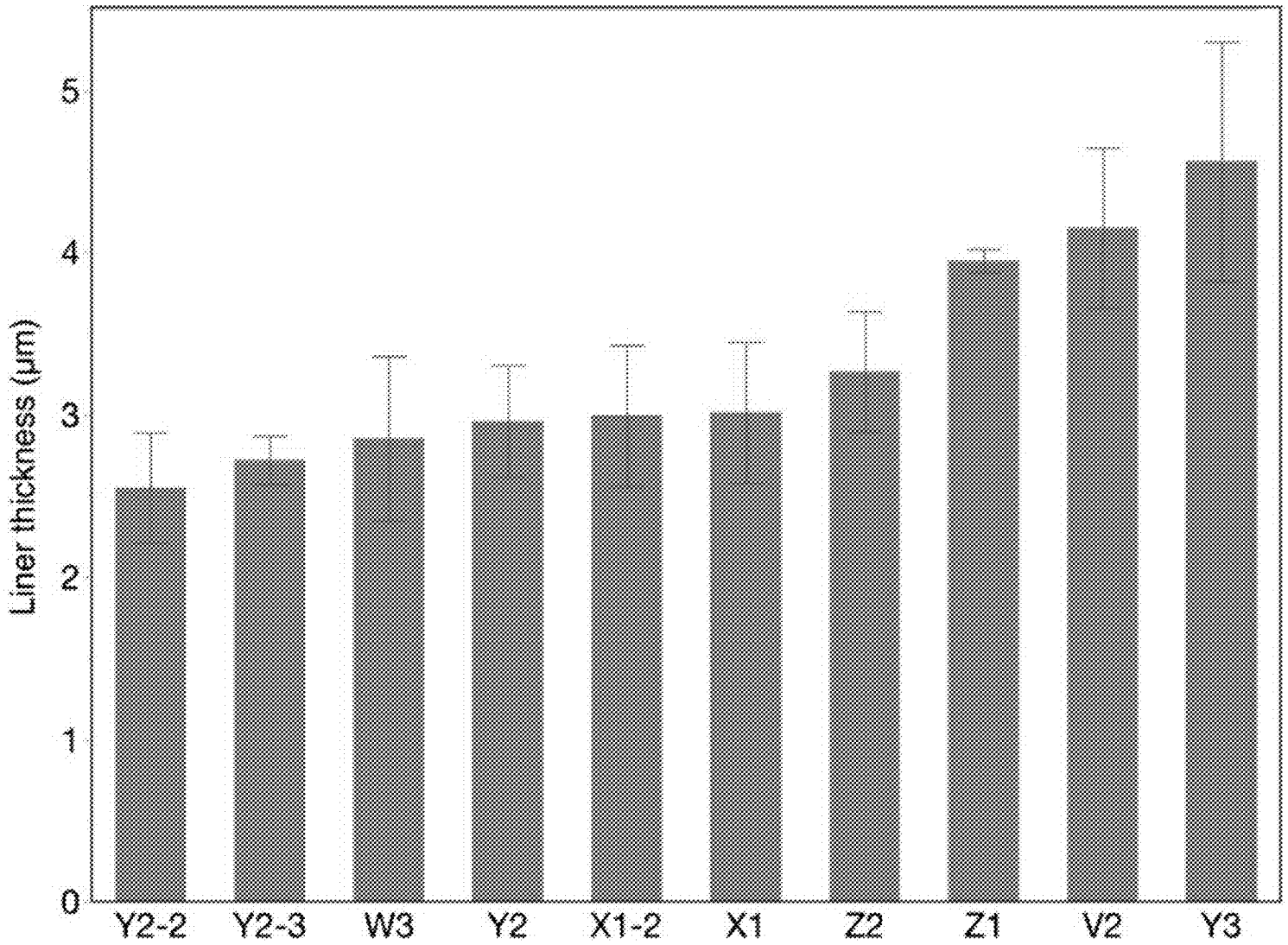
FIG. 8 is a graphical representation of can body liner thickness from 10 different can types, as measured by laser-scanning profilometer.
Figure 9:
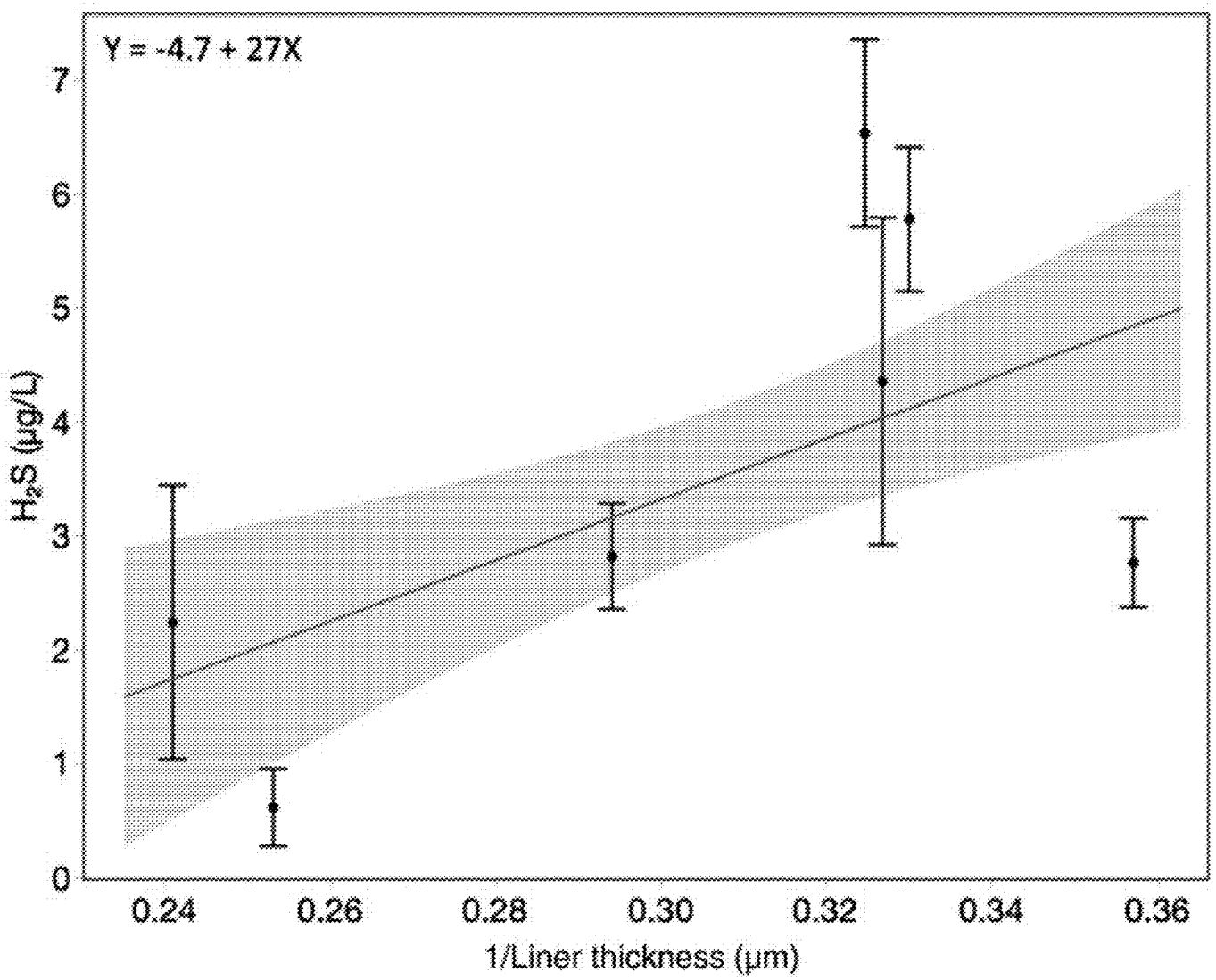
FIG. 9 is a graphical representation of hydrogen sulfide ($H_2S$) formation after three days at 50° C. versus inverse liner thickness for epoxy lined cans.

With reference now to FIG. 8, a graphical representation of can body liner thickness from 10 different can types, as measured by laser-scanning profilometer (n=3 cans per liner type) is illustrated. Prior experimental work demonstrated that liner chemistry is a principal determinant of gas formation, with acrylic liners yielding more than ten-fold higher $H_2S$ concentrations than epoxy-based liners. However, both long-term and accelerated-aging results of the present study revealed comparable variation among cans employing nominally identical liner chemistries but sourced from different manufacturers. Accordingly, variation in performance (including average $H_2S$ formation and can-to-can variance) was hypothesized to originate from one or more of the following: aluminum alloy composition, polymeric liner formulation, degree of polymer cross-linking or cure, and liner thickness and uniformity.

Figure 19:
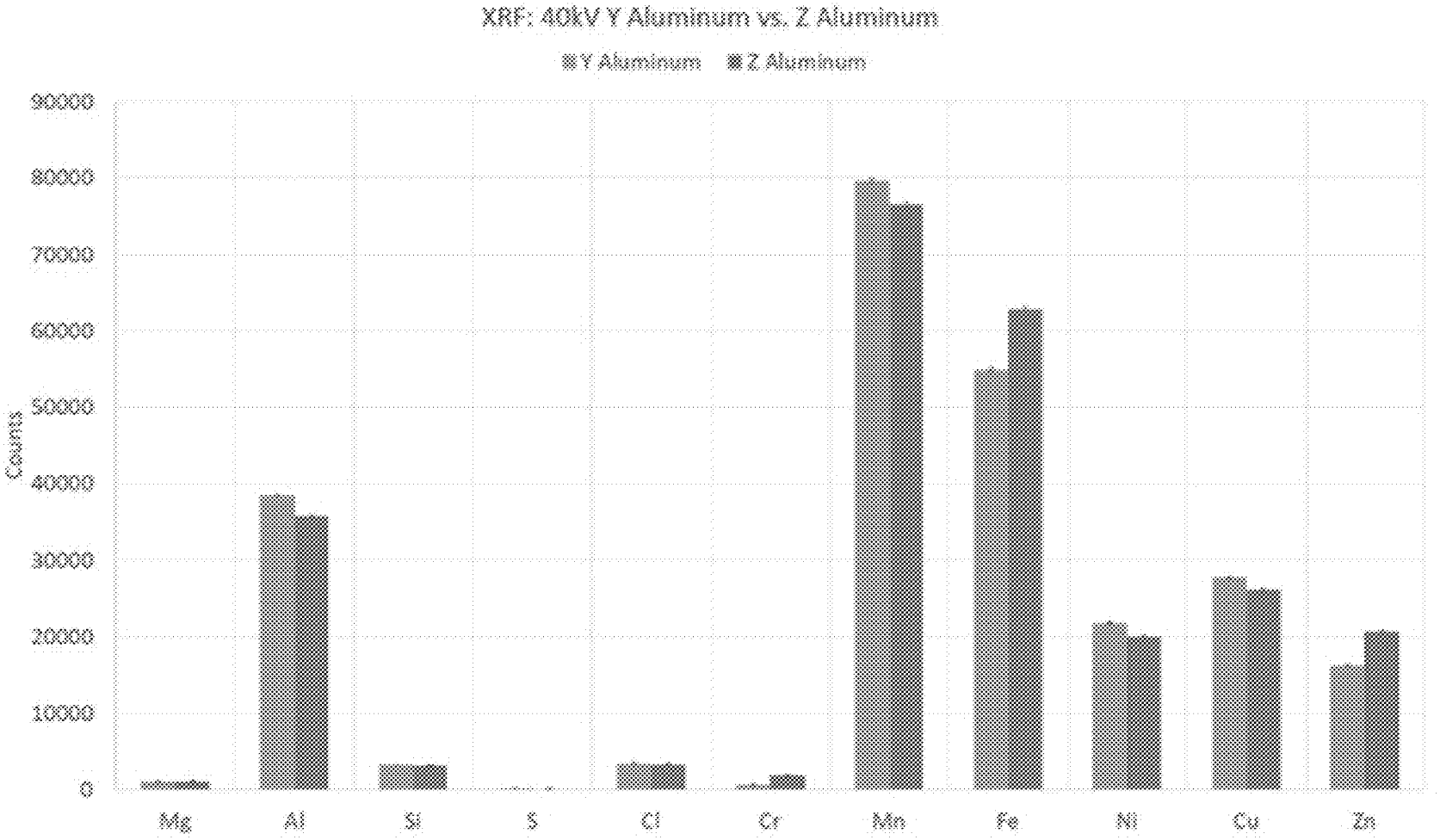
FIG. 19 illustrates an elemental analysis by x-ray fluorescence (XRF) for Y2 and Z2 cans.

In one embodiment, the aluminum alloy compositions of the BPA-NI epoxy can bodies produced by manufacturers Y and Z were analyzed via X-ray fluorescence (XRF) spectroscopy, as shown in FIG. 19. These sources were selected because they employed the same nominal liner chemistry, thereby isolating alloy composition as a variable. Results were semi-quantitative, as calibration standards were not included. Among detected elements, only chromium (Cr) exhibited variation exceeding 20%, with the Z series containing approximately three-fold higher Cr than Y. Given that Cr is typically present in the Al 3004 alloy at concentrations below 0.05%, this difference was unlikely to materially influence $H_2S$ evolution. Other trace elements such as copper (Cu), which in its soluble Cu(II) state can complex with or sequester sulfide species, showed differences below 20%, further suggesting that bulk alloy composition alone does not explain the observed variability in $H_2S$ accumulation.

Figure 20:
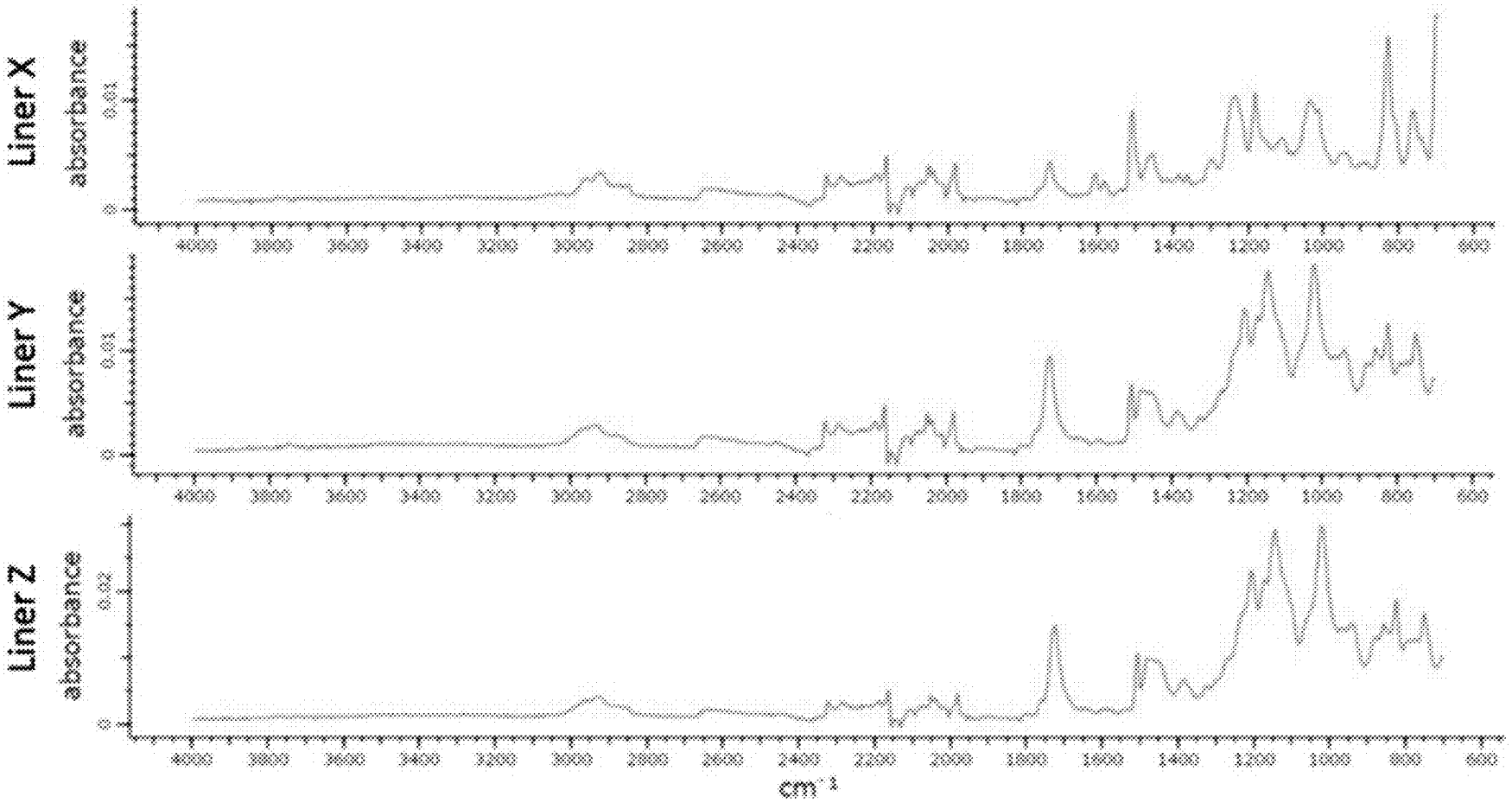
FIG. 20 illustrates an FTIR-ATR spectra of three liners (on aluminum substrate) used in a long-term storage experiment.

In an embodiment, polymeric liner composition may be characterized using Fourier-transform infrared spectroscopy with attenuated total reflectance (FTIR-ATR). Representative spectra for liners extracted from cans $X_1$, $Y_2$, and $Z_2$ are shown in FIG. 20. The BPA epoxy liner ($X_1$) exhibited minor spectral differences from the two BPA-NI epoxy liners ($Y_2$ and $Z_2$), but the latter two appeared identical-consistent with manufacturer documentation identifying both as Valspar V70 (tetramethyl bisphenol F) coatings. Major peaks were observed at approximately 1725, 1510, 1210, 1140, and 1030 $cm^{-1}$, corresponding to characteristic carbonyl stretching, aromatic ring vibration, and C—O—C epoxy linkages.

In some embodiments, liner integrity may be evaluated using electrochemical and optical methods, including enamel-rating (DC current) testing, electrochemical impedance spectroscopy (EIS), acid-copper displacement assays, and adhesion testing. Metal-exposure analysis (enamel rating) applies a direct-current potential (typically 6.3 V) across the can wall, with the measured current proportional to the exposed metal surface area. Industrial quality-control thresholds vary with beverage corrosivity; for example, a 75 mA cutoff is common for beer, whereas a ≤5 mA threshold is recommended for acidic beverages such as wine (Fetters et al., 2004). In the present study, enamel-rating currents for all three long-term test cans were below 4 mA, indicating minimal direct exposure of aluminum. Testing of the visibly defective $Y_2$-2 cans produced only two failures among fifteen samples, likely because an insulating $Al_2O_3$ layer had passivated exposed regions before analysis. These findings suggest that enamel-rating may be less sensitive when evaluating aged or pre-oxidized cans and may be more applicable for in-process manufacturing control than for end-user quality validation.

EIS analysis, employing an alternating-current potential, provides a complementary measure of liner barrier performance by modeling the can-liner system as a resistor-capacitor (RC) circuit. In the current study, impedance was measured at 0.05 Hz, an accepted proxy for corrosion resistance, yielding average values near 10 MΩ, exceeding the minimum recommended threshold for corrosion prevention. No statistically significant differences were detected among the three can sources, which was unexpected given prior literature suggesting that lower impedance correlates with poorer long-term performance. Without being bound by theory, it is possible that the highly reactive components of wine, especially $SO_2$, progressively degrade epoxy-based liners during extended storage, a phenomenon not observable in the short-term EIS tests conducted within one hour of filling. Future embodiments may incorporate time-series EIS measurements into predictive maintenance or liner-degradation models to capture dynamic changes in impedance over storage periods exceeding 14 days. Acidified copper-sulfate testing of unused cans did not reveal visible copper deposition or aluminum-sulfate precipitation, suggesting the absence of macroscopic voids (≥0.05 mm). Likewise, ASTM D3359-17 adhesion testing showed no measurable liner delamination, confirming acceptable adhesion strength for all liners evaluated. However, it is noted that oxide-layer formation between manufacturing and testing may have reduced the sensitivity of both assessments.

Liner-thickness measurements were obtained by laser-scanning profilometry on uniformly coated regions. The $Z_2$ cans exhibited an average liner thickness of 3.27 μm±0.37 μm, significantly greater than $Y_2$ (2.96 μm±0.35 μm), while the $X_1$ cans were intermediate (3.01 μm±0.43 μm). Although this ≈10% increase in mean thickness could contribute to the improved stability of the $Z_2$ cans, profilometry also revealed a higher proportion of thin-coating areas (<0.5 μm) and localized aluminum exposure in $Z_2$ relative to the other groups. Accordingly, overall liner thickness alone is not sufficient to explain reduced $H_2S$ generation; rather, uniformity and coating continuity across the interior surface appear more critical.

With continued reference to FIG. 8, in some embodiments, cans sourced from manufacturer Z and manufacturer V exhibited distinct performance advantages under accelerated aging conditions. Specifically, manufacturer Z's BPA epoxy and manufacturer V's BPA-NI epoxy slim-format cans produced minimal hydrogen sulfide ($H_2S$) accumulation in the accelerated-aging protocol (corresponding to FIG. 7) and were characterized by significantly greater average liner thicknesses (as shown in FIG. 8) relative to the remaining liner types analyzed (Student's t-tests, $p<0.05$). Notably, these cans maintained lower $H_2S$ formation despite a comparatively larger internal surface area, suggesting that liner thickness and uniformity may outweigh surface-area-driven effects in governing gas evolution and corrosion resistance With reference now to FIG. 9, a graphical representation of hydrogen sulfide ($H_2S$) formation after three days at 50° C. versus inverse liner thickness for epoxy lined cans (BPA and BPA-NI) is illustrated. Each point represents the average $H_2S$ for a different liner (n=8 technical replicates per liner). Error bars represent one standard error. Acrylic liners and the visibly defective Y2-2 cans were excluded from this regression due to their known coating irregularities. For purposes of this disclosure, the "inverse liner thickness" refers to the reciprocal of the measured coating thickness and serves as a proportional estimator for coating permeability and, therefore, the expected rate of sulfur dioxide ($SO_2$) diffusion through the liner. A statistically significant correlation was observed between the inverse of liner thickness and the amount of $H_2S$ produced, indicating that thinner or more permeable coatings permit enhanced $SO_2$ transport and subsequent reductive sulfur formation.

The two liner groups that produced the least $H_2S$, namely Y2-3 and Z1 (see FIG. 7), also exhibited the lowest standard deviations in liner thickness (see FIG. 8), suggesting that consistency of coating application, rather than absolute mean thickness alone, governs diffusion stability. Without being bound by theory, it is postulated that micro-thin or under-cured regions may act as preferential diffusion channels, accelerating localized $SO_2$ permeation and thus $H_2S$ generation. Interestingly, the cans with the thinnest average liner, designated Y2-3, produced intermediate amounts of HS, despite their reduced thickness. These cans were identified as "soda-weight" or "beer-weight" designs intended for lower-acidity products and thus received a thinner coating and lower cure temperature than "hard-to-hold" beverage cans (e.g., those used for wine, sour beer, or kombucha). All other cans in the study were designed for these more reactive beverage classes and therefore featured thicker liners and more stringent quality-control validation (e.g., enamel-rater and cure-integrity testing). This distinction supports the inference that manufacturing classification and thermal cure parameters may be integrated as categorical variables in the predictive compatibility model to account for performance variation across intended product categories.

Although the acrylic liner group (Y3) displayed the highest average liner thickness among all evaluated samples (see FIG. 8), it nonetheless exhibited substantial $H_2S$ accumulation. This observation is consistent with prior findings demonstrating that $SO_2$ and other wine constituents can chemically degrade acrylic resins, compromising liner integrity and exposing the underlying aluminum substrate. In further embodiments, liner-thickness data may also be acquired by optical interferometry to validate profilometric results across broader surface regions. Interferometric analysis yields averaged thickness values across 1-2 $mm^2$ sampling windows, providing macro-level thickness mapping but without micron-scale precision. For the three can sources evaluated in long-term storage studies. The order of average and minimum thickness (Z>X>Y) measured by interferometry matched that observed using laser-scanning profilometry, confirming consistency across measurement techniques. Accordingly, the empirical correlation between inverse liner thickness and $H_2S$ formation depicted in FIG. 9 demonstrates that the permeability and uniformity of the polymeric barrier are primary determinants of chemical stability. These findings substantiate the predictive compatibility model's underlying logic, wherein liner-thickness metrics and their statistical dispersion are incorporated as input features for estimating diffusion-limited reaction probabilities, guiding both liner selection and recommended coating specifications for future canning operations.

Figure 10:
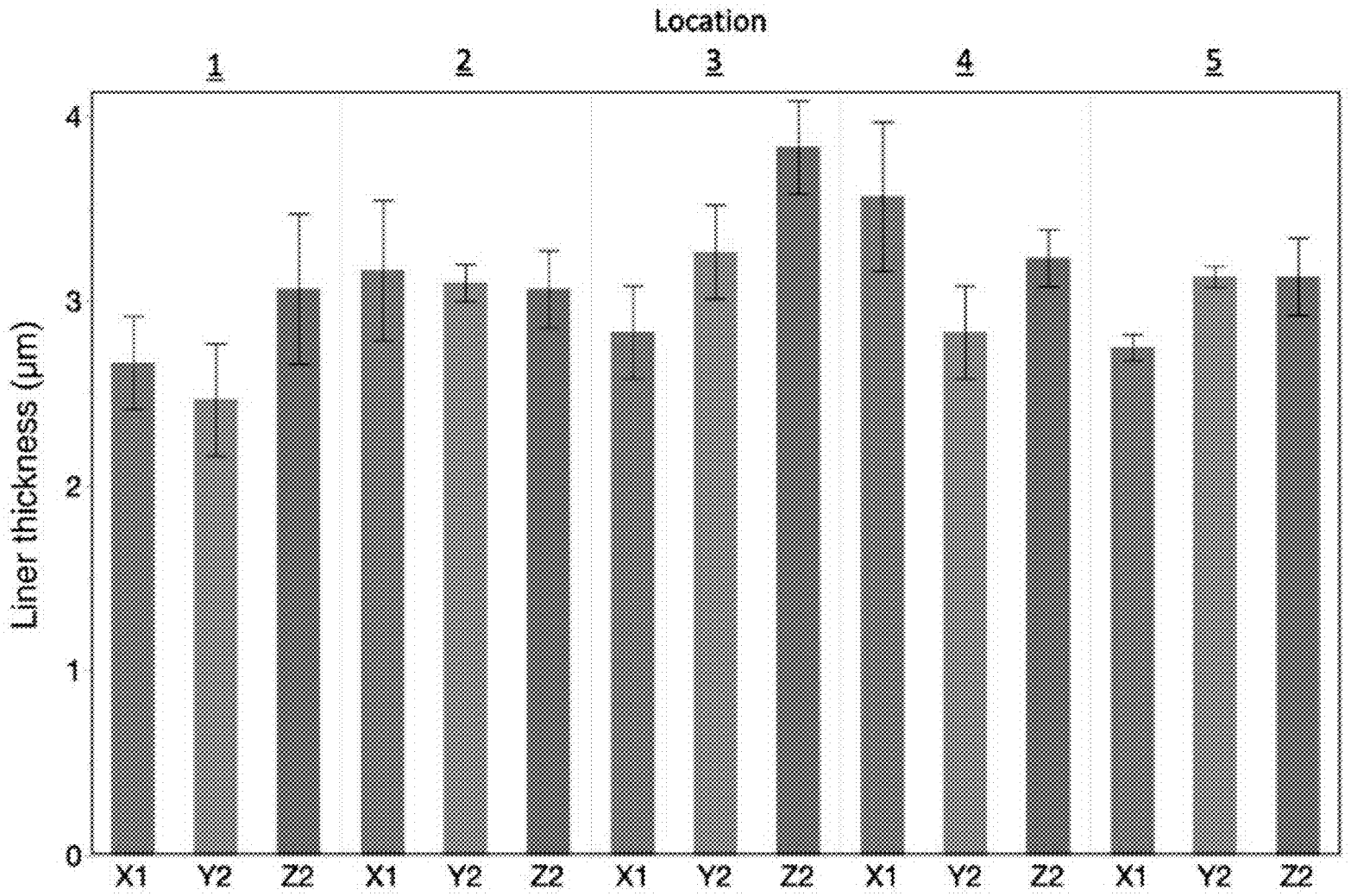
FIG. 10 is a graphical representation of liner thickness measurements by laser-scanning profilometry, measured across the cans (X1, Y2, and Z2)

With continued reference to FIG. 10, a graphical representation of liner thickness measurements by laser-scanning profilometry, measured across the cans (X1, Y2, and Z2). Three technical replicates were analyzed. Error bars represent one standard deviation. X1, Y2, Z2: X, Y, and Z signify the can manufacturer; 1 and 2 signify the liner type (BPA epoxy and BPA-NI epoxy, respectively). For example, Y2 indicates a BPA-NI epoxy can from manufacturer Y. In some embodiments, liner-thickness measurements were also obtained for the underside of can ends, which are regions that rarely exhibit visible corrosion during long-term storage. Measurements were taken on flat portions of the can end to ensure optical uniformity, and the average liner thickness was determined to exceed approximately 8 μm, roughly threefold greater than the corresponding thicknesses observed in the can body. Without being bound by theory, this increased thickness is believed to contribute to the enhanced corrosion resistance commonly observed in these regions, as the augmented polymer barrier limits both oxygen ingress and sulfur dioxide ($SO_2$) permeation into the underlying aluminum substrate. In some embodiments, liner-thickness mapping was performed across multiple internal locations within the can body and headspace for the three can sources evaluated in long-term aging trials. Measurements were conducted by laser-scanning profilometry, as schematically represented in FIG. 2 and graphically summarized in FIG. 10, encompassing five distinct sampling sites along the can interior. The thinnest liner coverage (~2.5 μm) was consistently observed in the upper headspace region (Location 1) of the Y2 cans, correlating with elevated hydrogen sulfide ($H_2S$) formation previously measured in that same region.

In some embodiments, this spatial correlation between liner thickness and $H_2S$ generation supports the inference that regions exhibiting thinner or non-uniform coatings demonstrate shorter onset times for measurable gas accumulation, assuming equivalent beverage composition and environmental conditions.

In some embodiments, experimental validation confirmed that the molecular sulfur dioxide ($SO_2$) fraction of total sulfites represents the most reliable predictor of hydrogen sulfide ($H_2S$) formation during long-term storage of canned wine compositions across a range of beverage formulations and liner chemistries. Significant variability in both $H_2S$ accumulation and visible corrosion was observed not only among cans incorporating different polymeric liner materials, but also among cans utilizing nominally identical liner chemistries sourced from different manufacturers. Furthermore, can-to-can variation within a single manufacturer's production batch was found to be non-negligible, indicating that micro-scale differences in coating application, curing, or substrate treatment may materially influence stability performance.

In some embodiments, physical, optical, and mechanical integrity assessments of unused cans, such as enamel rating, adhesion, and impedance spectroscopy, did not consistently predict long-term corrosion or gas-evolution behavior. However, statistical correlation analysis demonstrated that performance variation among can groups was modestly associated with differences in liner thickness and uniformity, supporting the inference that coating geometry plays a partial, but not exclusive, role in mediating chemical stability. Without being bound by theory, it is postulated that liner degradation through chemical reaction with dissolved sulfites, rather than purely mechanical failure, represents a primary initiation pathway for corrosion and $H_2S$ formation.

With reference now to FIG. 11, a table illustrating initial composition of wines used in the long-term canning study is shown. These parameter values may serve as baseline conditions from which permissible deviations are determined and from which liner-compatibility simulations are initiated. The table further illustrates variability among different beverage types, such as Pinot Grigio, Sauvignon Blanc, French Rose, sparkling Rose, and sparkling White.

With reference now to FIG. 12A, a table of parameters for open circuit potential testing is shown. In some embodiments, parameters for open circuit potential (OCP) testing are presented to illustrate the electrochemical validation conditions used to assess liner integrity and aluminum corrosion susceptibility. For purposes of this disclosure, the OCP test measures the equilibrium potential between the can substrate and a reference electrode in the absence of externally applied current, providing a non-destructive indication of the coating's barrier performance. In an embodiment, FIG. 12A presents representative experimental parameters including electrolyte composition, electrode configuration, stabilization criteria, potential drift thresholds, and measurement duration.

It will be understood that the parameters listed in FIG. 12A are exemplary and non-limiting. Variations in electrolyte concentration, reference electrode type, or stabilization criteria may be implemented without departing from the scope of the disclosed embodiments.

With reference now to FIG. 12B, a table of parameters for electrochemical impedance spectroscopy testing is shown. In some embodiments, parameters for electrochemical impedance spectroscopy (EIS) testing are provided to illustrate representative electrochemical conditions for evaluating the barrier performance and degradation behavior of polymeric liners. For purposes of this disclosure, EIS testing involves the application of an alternating current (AC) signal across the liner-electrolyte interface while measuring impedance as a function of frequency, thereby characterizing both resistive and capacitive components of liner integrity. In an embodiment, FIG. 12B depicts exemplary testing parameters including frequency range, AC amplitude, applied DC bias, open-circuit potential (OCP) stabilization period, electrolyte composition, and data-acquisition intervals.

It will be appreciated that the specific parameters shown in FIG. 12B are exemplary and may be varied according to the electrolyte system, liner chemistry, or measurement instrumentation without departing from the scope of the disclosed embodiments. In an embodiment, EIS parameters such as those shown in FIG. 12B may be stored as metadata linked to individual liner performance records, enabling correlation between electrochemical response and predicted long-term packaging stability.

Figure 13:
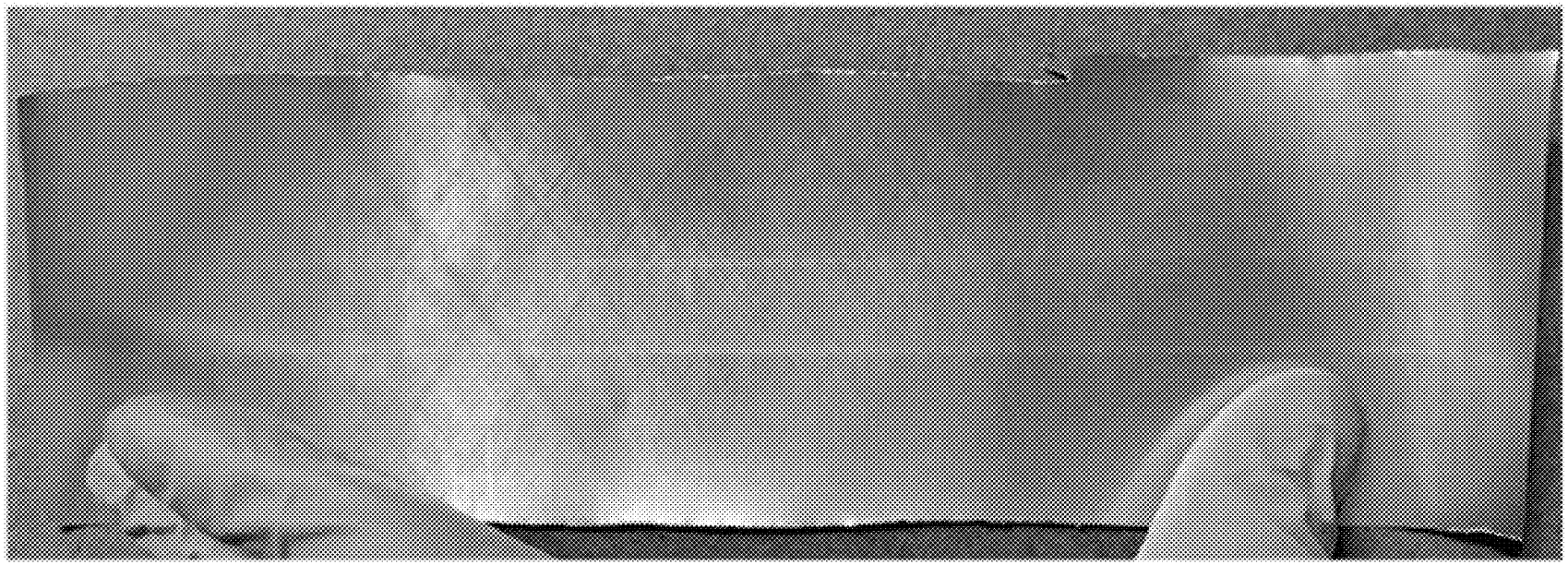
FIG. 13 is an illustration of a can body with its top and bottom removed.

With reference now to FIG. 13, an illustration of a can body with the top and bottom removed is shown. In some embodiments, a schematic representation of a prepared aluminum can body is shown, with the top and bottom sections removed to facilitate liner evaluation and coupon preparation. For purposes of this disclosure, removal of the top and bottom portions of the can allows access to the internal surface of the cylindrical body for subsequent sectioning, cleaning, and analytical characterization. In an embodiment, the can body depicted in FIG. 13 may correspond to the configuration used for preparing aluminum coupons for accelerated aging trials or for optical and electrochemical liner assessments.

Figure 14:
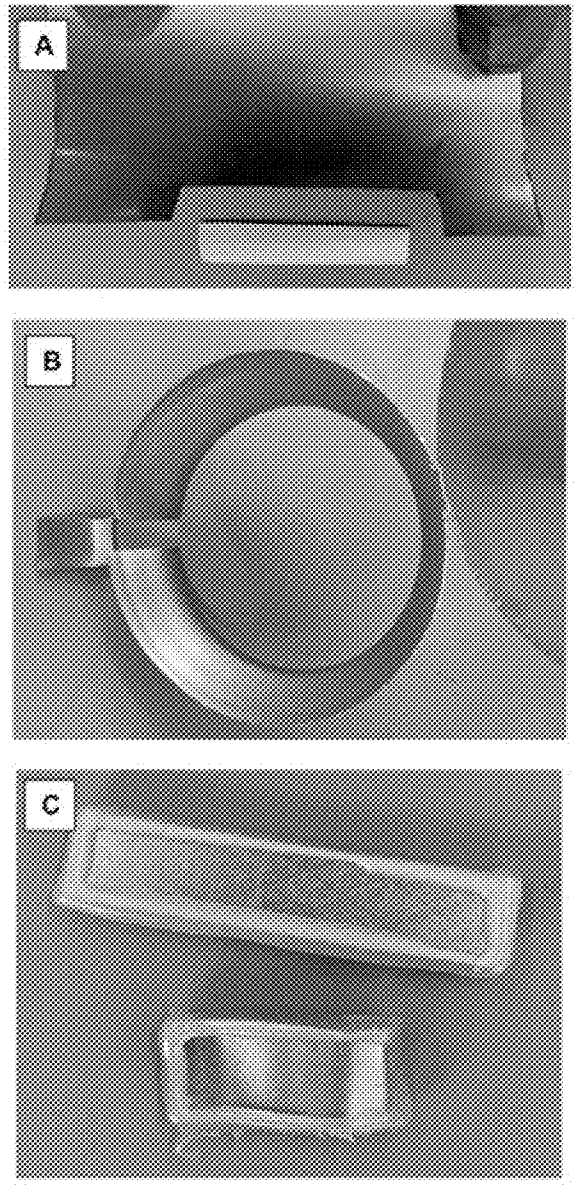
FIG. 14 illustrates exemplary locations and configurations of aluminum coupons used for accelerated aging texting, including (A) body-region coupons, (B) headspace-region coupons, and (C) sealed-edge coupons prepared with hot-melt adhesive to prevent bare aluminum exposure during testing.

With reference now to FIG. 14, illustrated is exemplary locations and configurations of aluminum coupons used for accelerated aging texting, including (A) body-region coupons, (B) headspace-region coupons, and (C) sealed-edge coupons prepared with hot-melt adhesive to prevent bare aluminum exposure during testing. in some embodiments, representative sampling locations and coupon configurations used for accelerated aging testing are shown. (A) body illustrates exemplary coupon sections obtained from the body region of an aluminum can, while (B) headspace illustrates coupons sectioned from the headspace region of the can. Each coupon represents a defined area of liner-coated substrate selected for evaluation under controlled chemical and thermal conditions. For purposes of this disclosure, such coupons are used to replicate the localized liner-beverage interactions occurring in distinct geometric regions of the full container.

As shown at location C, the exposed aluminum along the cut edges of each coupon may be sealed using a hot-melt adhesive material (e.g., ethylene-vinyl acetate), thereby isolating the coated surface and preventing direct exposure of bare aluminum during immersion testing. In an embodiment, sealing the edges with a non-reactive polymer ensures that observed chemical or electrochemical responses arise exclusively from liner-beverage interactions rather than edge corrosion or galvanic interference.

Figure 15:
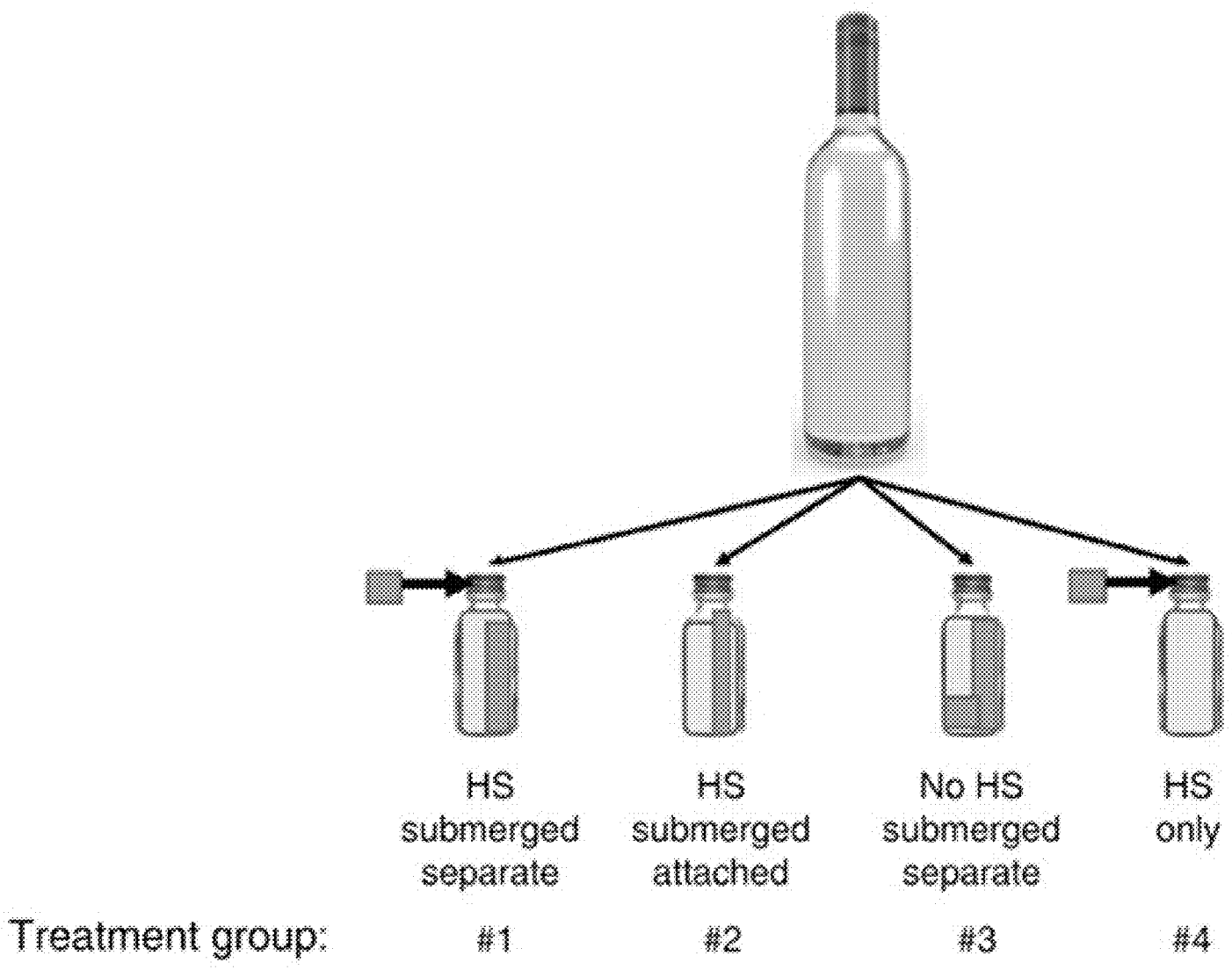
FIG. 15 illustrates an exemplary experimental design for comparing immersed and non-immersed aluminum surfaces during accelerated aging, showing coupon orientations corresponding to headspace (HS) and submerged exposure regions.

With reference now to FIG. 15, illustrated is an exemplary experimental design for comparing immersed and non-immersed aluminum surfaces during accelerated aging, showing coupon orientations corresponding to headspace (HS) and submerged exposure regions. Four technical replicates were performed for each treatment configuration. FIG. 15 illustrates an experimental configuration for evaluating the relative effects of immersed and non-immersed aluminum surfaces on hydrogen sulfide ($H_2S$) formation during accelerated aging. For purposes of this disclosure, the arrangement shown in FIG. 15 demonstrates the orientation of coated aluminum coupons within sealed vials, allowing comparative analysis of headspace-exposed (HS) and liquid-immersed regions under identical thermal and chemical conditions.

In an embodiment, FIG. 15 depicts four representative coupon orientations, each corresponding to a unique combination of immersion depth and exposure environment. These configurations include fully submerged coupons, partially submerged coupons with defined vapor exposure area, and headspace-mounted coupons affixed to vial septa. Each configuration was tested in quadruplicate (four technical replicates per treatment), enabling statistical evaluation of $H_2S$ generation as a function of surface exposure.

Figure 16:
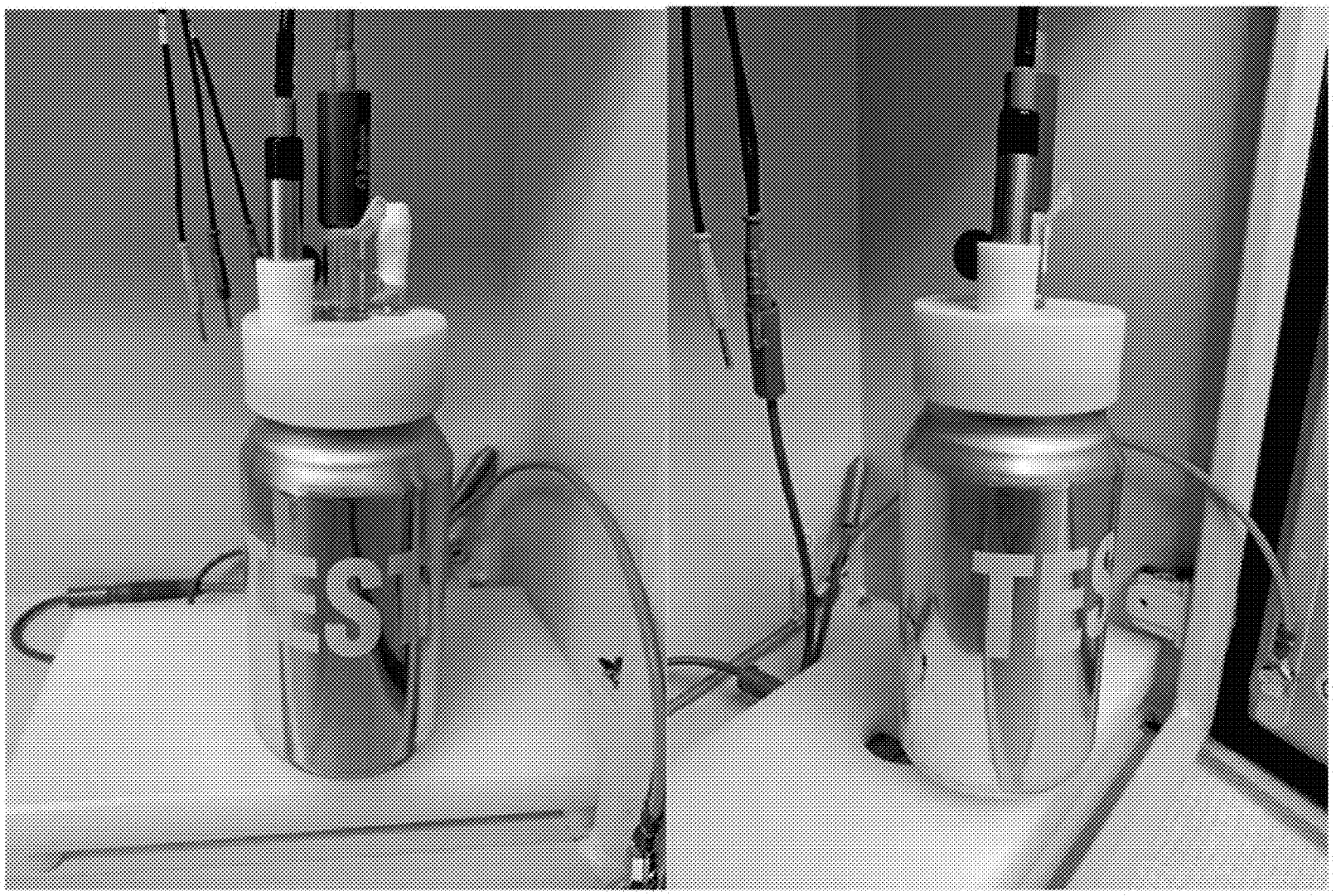
FIG. 16 illustrates an exemplary electrochemical impedance spectroscopy setup, showing the counter electrode (left), reference electrode (center), and working electrode (bottom of can)

With reference now to FIG. 16, illustrated is an exemplary electrochemical impedance spectroscopy setup, showing the counter electrode (left), reference electrode (center), and working electrode (bottom of can). The electrochemical cell is positioned inside a grounded Faraday cage to eliminate electromagnetic interference during measurement. In some embodiments, an electrochemical impedance spectroscopy (EIS) testing arrangement is illustrated for characterizing the electrical and barrier properties of can liners The can is filled with an electrolyte solution and functions as the electrochemical cell during testing. In an embodiment, the electrochemical cell is housed within a grounded Faraday cage, as shown in FIG. 16, to minimize external electromagnetic interference during measurement. This configuration ensures signal integrity and reproducibility when determining open-circuit potential and frequency-dependent impedance characteristics.

Figure 17:
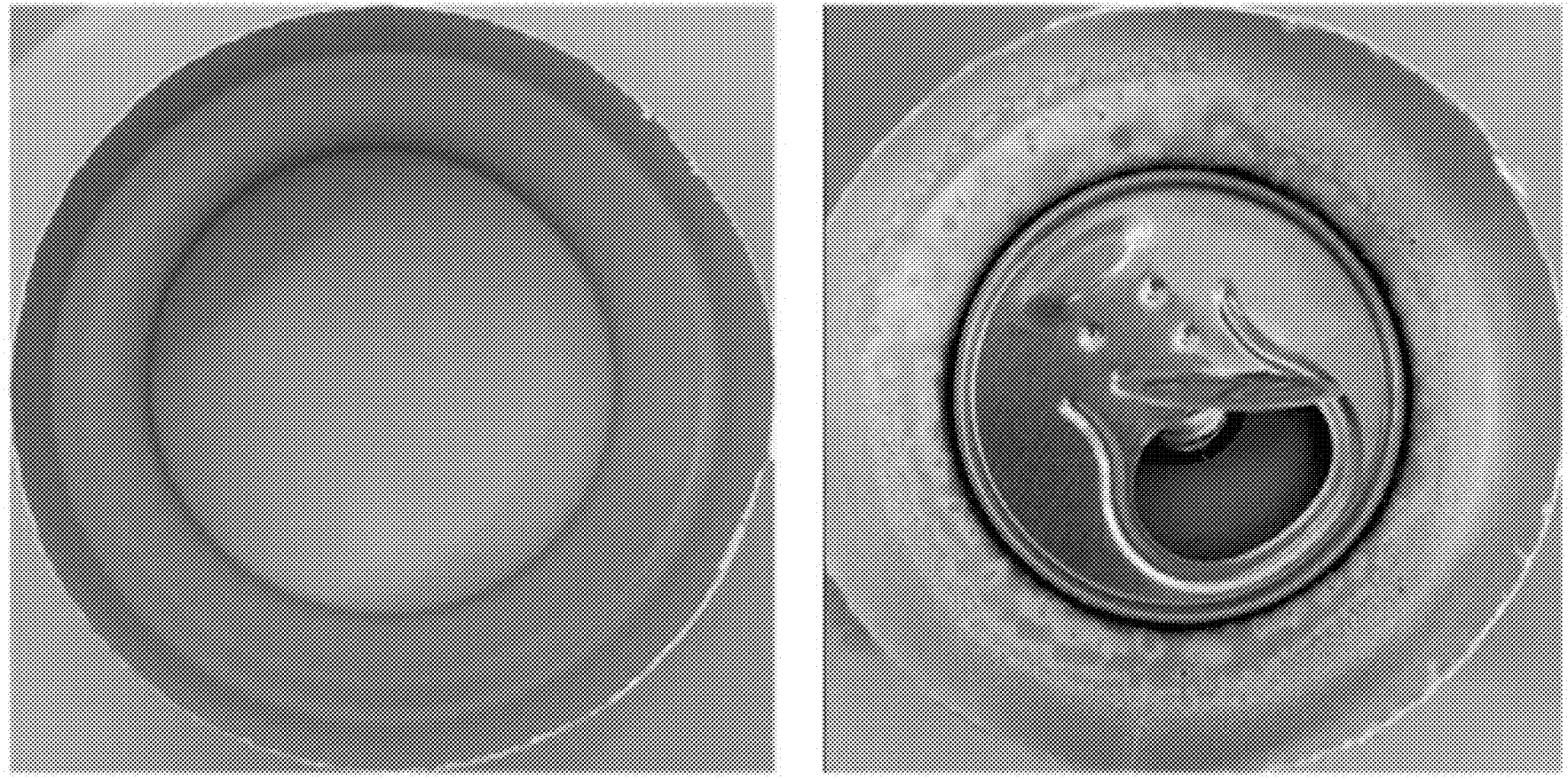
FIG. 17 illustrates a visual comparison between an unused can with no corrosion (left) and a used can exhibiting corrosion localized to the neck region (right)

With reference now to FIG. 17, illustrated is a visual comparison between an unused can with no corrosion (left) and a used can exhibiting corrosion localized to the neck region (right). In some embodiments, comparative visual evidence of corrosion patterns in aluminum beverage cans following long-term storage is shown. FIG. 17 (left) illustrates an unused can interior exhibiting an intact, uniformly coated liner surface with no visible corrosion. FIG. 17 (right) depicts a corresponding can after product storage, showing localized corrosion primarily concentrated in the upper neck region of the container. In an embodiment, the observed corrosion is indicative of liner degradation or reduced coating performance in high-curvature regions, which may experience greater mechanical stress or thinner applied coatings during manufacturing. The neck region often presents a more challenging geometry for achieving uniform liner coverage, making it a potential site for accelerated degradation when exposed to acidic or sulfur-containing beverages.

Figure 18:
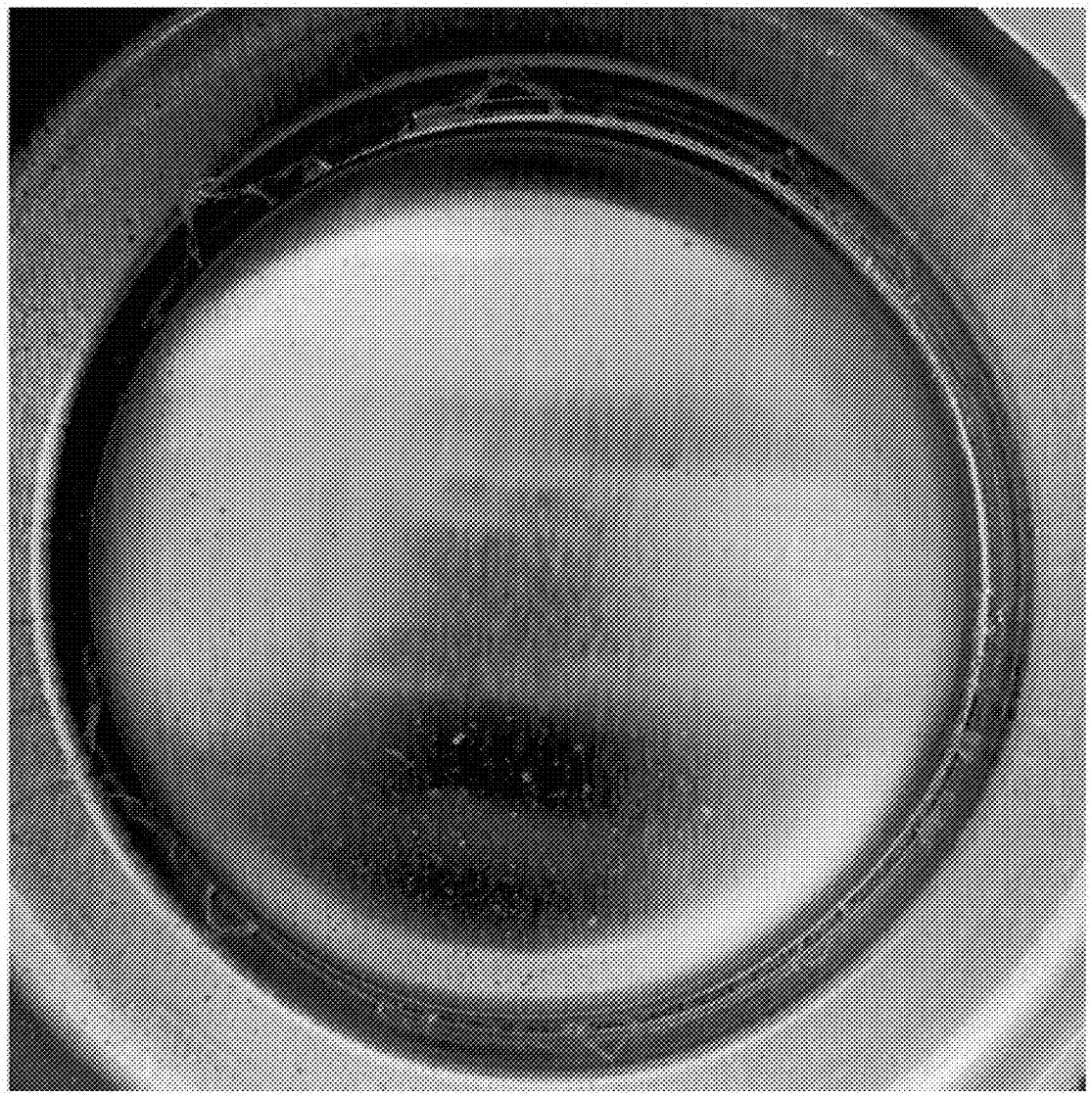
FIG. 18 illustrates visual defects in a polymeric lining of a moat region of Y2-2 cans prior to storage.

With reference now to FIG. 18, illustrated is visual defects in the polymeric lining of the moat region of Y2-2 cans prior to storage. The Y2-2 code designates the second batch of BPA-NI epoxy-lined cans from manufacturer Y, tested to evaluate batch-to-batch variation. In some embodiments, representative visual defects are illustrated in the polymeric liner of the "moat" region of certain aluminum beverage cans. The depicted example corresponds to the Y2-2 batch, wherein "Y" denotes the manufacturer and "2" denotes the liner type (BPA-NI epoxy). Multiple production batches from the same manufacturer were evaluated (e.g., Y2, Y2-2, Y2-3) to assess batch-to-batch variability in liner uniformity and integrity.

In some embodiments, as depicted in FIG. 18, the polymeric liner exhibits incomplete coverage and localized thinning along the recessed curvature of the moat region. These areas represent critical weak points where liquid ingress or liner delamination may initiate during product storage, leading to elevated hydrogen sulfide formation or visible corrosion. In an embodiment, batch-to-batch variation in liner application parameters, such as spray angle, viscosity, and cure temperature, may account for the irregularities observed in FIG. 18. Consistent with experimental findings, this batch (Y2-2) produced approximately ten-fold higher $H_2S$ concentrations than other batches of the same liner chemistry, confirming that mechanical or geometric nonuniformities in liner deposition can significantly influence long-term can performance.

With reference now to FIG. 19, illustrated is an elemental analysis by x-ray fluorescence (XRF) for Y2 and Z2 cans. Each sample represents a BPA-NI epoxy-lined can, with three technical replicates analyzed per manufacturer. Y2 and Z2 indicate cans from manufacturers Y and Z, respectively. In some embodiments, comparative results of elemental analysis conducted by x-ray fluorescence (XRF) spectroscopy for cans Y2 and Z2 are shown. Each sample corresponds to a BPA-NI epoxy-lined can, wherein the letter (Y or Z) denotes the manufacturer and the number "2" denotes the liner type. Three technical replicates were analyzed per manufacturer.

As depicted in FIG. 19, both Y2 and Z2 cans exhibited comparable base compositions consistent with Al 3004 alloy specifications, including characteristic peaks for aluminum, manganese, magnesium, and trace transition metals. However, detectable variation in minor alloying elements such as chromium (Cr) and copper (Cu) was observed between the two sources. In particular, manufacturer Z exhibited approximately three-fold higher Cr intensity relative to manufacturer Y, while all other element peak intensities varied by less than 20%. In some embodiments, the relative abundance of alloying elements revealed by XRF spectroscopy may serve as an indicator of metallurgical consistency or manufacturing variability. Although such differences were not found to correlate strongly with hydrogen sulfide (HS) formation under accelerated or long-term storage conditions, the analysis demonstrates that subtle deviations in alloy composition can be systematically quantified as part of a broader diagnostic workflow for predicting can performance.

With reference now to FIG. 20, illustrated is an FTIR-ATR spectra of three liners (on aluminum substrate) used in the long-term storage experiment. X1, Y2, and Z2 denote can manufacturers X, Y, and Z, respectively; liner types 1 and 2 correspond to BPA epoxy and BPA-NI epoxy formulations. In some embodiments, Fourier transform infrared-attenuated total reflectance (FTIR-ATR) spectra obtained from the polymeric liners of three representative can types (X1, Y2, and Z2) are shown. Each liner was applied on an aluminum substrate and corresponds to a liner formulation used in the long-term storage study. Specifically, the X1 can includes a BPA epoxy liner, while Y2 and Z2 cans include BPA-NI epoxy liners. The letters X, Y, and Z signify the respective can manufacturers, and the numerals "1" and "2" designate the liner types.

As depicted in FIG. 20, the FTIR-ATR spectra exhibit strong absorbance bands near 1725 $cm^{-1}$, 1510 $cm^{-1}$, 1210 $cm^{-1}$, 1140 $cm^{-1}$, and 1030 $cm^{-1}$, corresponding to C═O stretching, aromatic C═C vibrations, and ether or hydroxyl-related stretching modes characteristic of epoxy-based coatings. Only minor spectral differences were observed between the BPA epoxy (X1) and BPA-NI epoxy (Y2, Z2) liners, consistent with their similar resin backbones. In an embodiment, the overlapping absorbance profiles of Y2 and Z2 liners indicate that both coatings are likely derived from similar formulations (e.g., tetramethyl bisphenol F epoxy resins such as Valspar V70). However, slight differences in relative peak intensity and baseline shape may reflect variations in cure temperature, film crosslinking, or pigment loading introduced during manufacturer-specific coating processes. Such differences could contribute to the distinct hydrogen sulfide ($H_2S$) generation trends observed in the long-term storage study.

Figure 21:
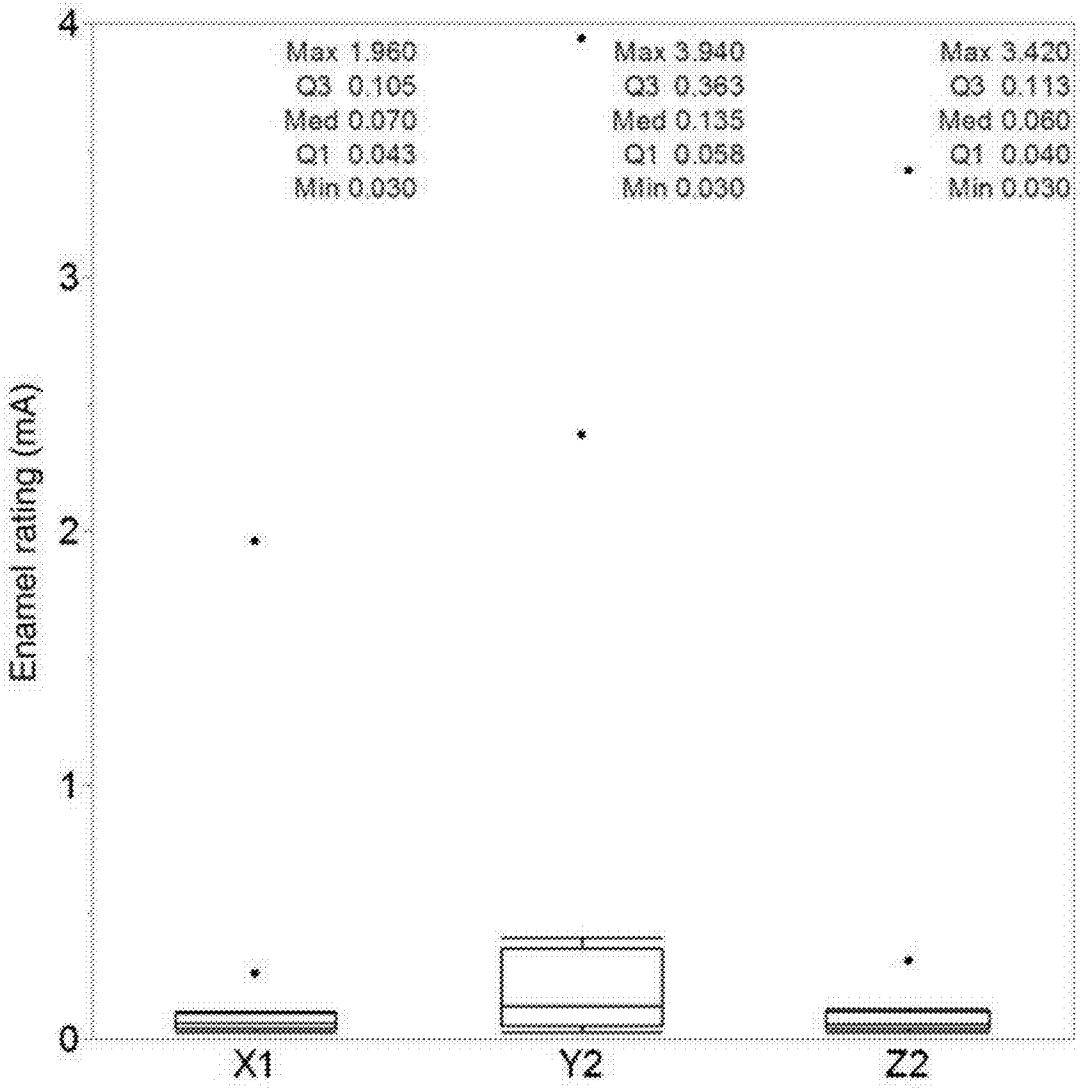
FIG. 21 illustrates metal exposure (enamel) ratings for three can types, X1 (BPA epoxy), Y2 (BPA-NI epoxy), and Z2 (BPA-NI epoxy), used in a long-term aging study (n=48)

With reference now to FIG. 21, illustrated is metal exposure (enamel) ratings for three can types, X1 (BPA epoxy), Y2 (BPA-NI epoxy), and Z2 (BPA-NI epoxy), used in the long-term aging study (n=48). Lower current values correspond to more complete liner coverage and lower metal exposure. In some embodiments, metal exposure ratings, also referred to as enamel ratings, for the three can types evaluated in the long-term storage study are shown. The enamel rating quantifies the extent of exposed aluminum substrate by measuring electrical current flow through an electrolyte in contact with the internal can surface under an applied potential. The three can types include X1 (BPA epoxy), Y2 (BPA-NI epoxy), and Z2 (BPA-NI epoxy). As before, the letters X, Y, and Z designate can manufacturers, and the numerals "1" and "2" designate the liner type.

As illustrated in FIG. 21, enamel rating currents were below 4 mA for all 48 tested samples (n=48), indicating minimal exposed aluminum and adequate liner coverage. No statistically significant differences were detected among the three can groups, suggesting that the liner application met industry specifications for barrier performance at the time of manufacture. The results were well below the threshold of 5 mA generally recommended for highly corrosive beverages such as wine and far below the 75 mA limit typically used for less corrosive beverages such as beer. In an embodiment, these enamel-rating results demonstrate that all three liner types initially exhibited satisfactory electrical insulation properties. However, because long-term $H_2S$ formation and corrosion were later observed to differ among the same can groups, the enamel-rating test alone may not fully predict chemical resistance or performance over time. This finding supports the conclusion that liner-wine chemical compatibility, rather than initial electrical barrier integrity, is the dominant factor influencing can stability during extended storage.

Figure 22:
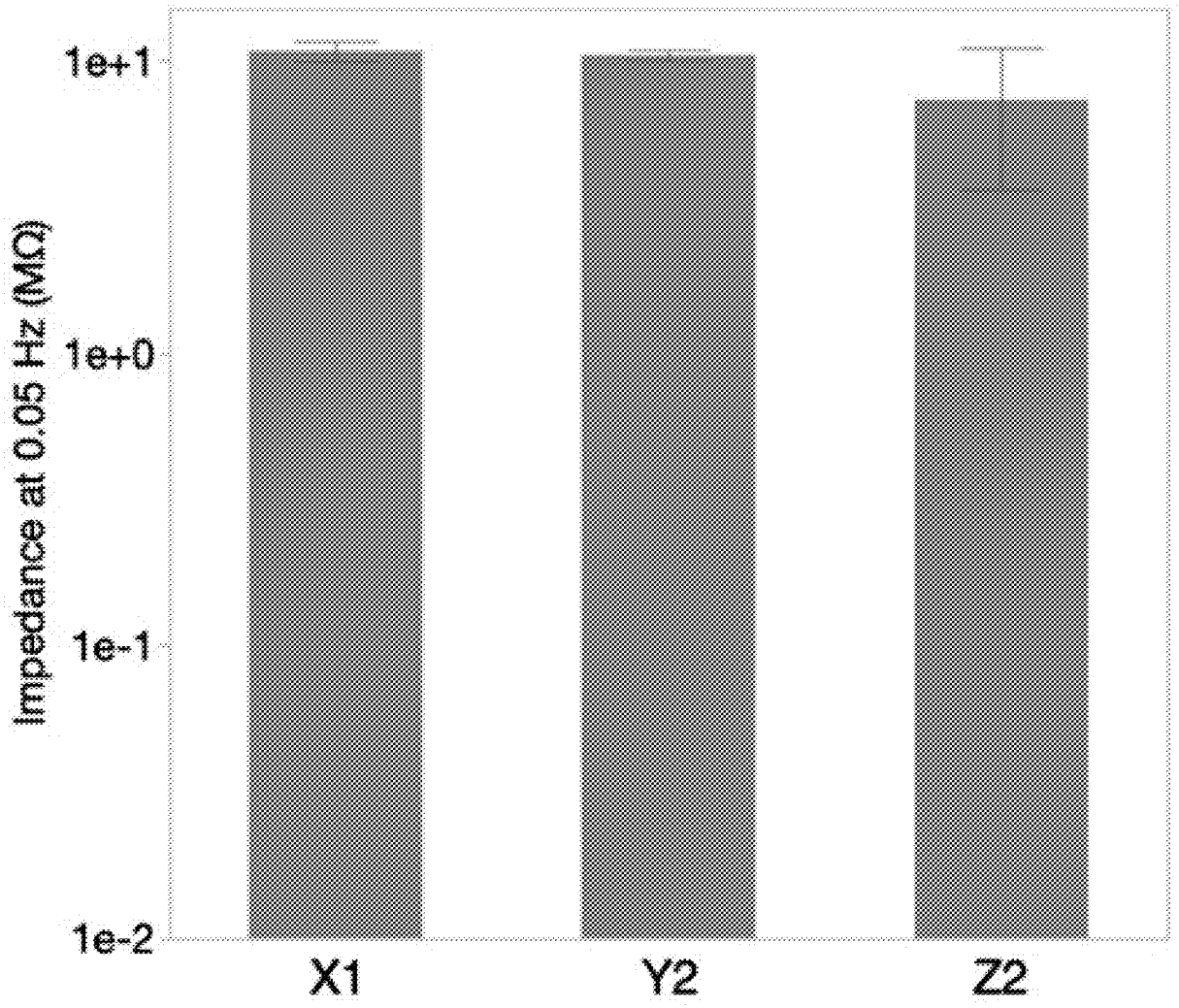
FIG. 22 illustrates impedance values at low frequency (0.05 Hz) for three can types, X1 (BPA epoxy), Y2 (BPA-NI epoxy), and Z2 (BPA-NI epoxy), used in the long-term aging study; The drawings are not necessarily to scale and may be illustrated by phantom lines, diagrammatic representations and fragmentary views. In certain instances, details that are not necessary for an understanding of the embodiments or that render other details difficult to perceive may have been omitted.

With reference now to FIG. 22, illustrated is impedance values at low frequency (0.05 Hz) for three can types, X1 (BPA epoxy), Y2 (BPA-NI epoxy), and Z2 (BPA-NI epoxy), used in the long-term aging study. Three technical replicates were tested for each can type (n=9). Error bars represent one standard error of the mean. In some embodiments, impedance values measured at a low-frequency operating point (0.05 Hz) for the three can types used in the long-term aging study are shown. The impedance values were obtained by electrochemical impedance spectroscopy (EIS) performed on intact, unused cans filled with a sodium chloride electrolyte. The evaluated can types included X1 (BPA epoxy), Y2 (BPA-NI epoxy), and Z2 (BPA-NI epoxy). As used herein, the letters X, Y, and Z designate can manufacturers, and the numerals "1" and "2" designate the liner type.

As depicted in FIG. 22, all three can types exhibited impedance magnitudes on the order of 10 MΩ at 0.05 Hz, a value consistent with a fully intact and continuous polymeric liner. Each can type was tested in triplicate (n=9 total), and error bars represent one standard error of the mean. No statistically significant differences in impedance were observed among the three liner groups, suggesting comparable initial electrochemical barrier performance across all tested cans. In some embodiments, the absence of significant variation in EIS-derived impedance among the liners indicates that, at time of manufacture, all coatings provided sufficient electrical insulation to limit ion transport through the film. However, long-term differences in hydrogen sulfide ($H_2S$) generation and corrosion behavior, as described elsewhere, imply that impedance measured immediately after filling may not capture liner degradation kinetics that manifest over time. The data therefore underscore that EIS can complement chemical compatibility testing when evaluating can performance for sulfur-containing beverages.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and apparatus according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A beverage-compatible container with resistance to degradation, the container comprising:

a body comprising a sidewall with an interior surface forming a cavity configured to hold an acidic or reactive beverage;

a liner disposed on at least a portion of the interior surface and configured to:

chemically isolate the interior surface of the body from the acidic or reactive beverage by resisting corrosion, oxidation, and sulfur-induced degradation; and preserve oxygen and sulfur barrier performance throughout storage of the acidic or reactive beverage within the body; and a base dome comprising a concave lower end of the body to enhance pressure tolerance, wherein internal radii at transitions between the sidewall and the base dome are coated by a uniform thickness of the liner to prevent stress-point delamination.

2. The container of claim 1, wherein the liner comprises a multilayer architecture comprising:

a functional barrier layer;

a surface layer; and an adhesion-promoter sublayer.

3. The container of claim 2, wherein the adhesion-promoted sublayer of the liner comprises a phosphate-functional adhesion system tuned to suppress under film corrosion.

4. The container of claim 2, wherein the functional barrier layer of the liner comprises a polyester-urethane network with enhanced hydrolysis resistance at pH below 3.5.

5. The container of claim 2, wherein the surface layer of the liner comprises an epoxy-polyester system with a low terpene uptake and reduced swelling in ethanol-containing matrices.

6. The container of claim 1, wherein the body comprises aluminum alloy sheet material formed by a draw-and-iron process, which elongates and thins the sidewall of the body to reduce mass while maintaining mechanical strength.

7. The container of claim 6, wherein the aluminum alloy is selected from a 3xxx series of aluminum alloys with a chromium-free conversion pretreatment configured to provide a stable oxide for primer sublayer bonding.

8. The container of claim 1, further comprising an upper flange comprising a double-seam contact region.

9. The container of claim 1, further comprising a lid configured to maintain hermetic sealing of the cavity under variable pressure conditions.

10. The container of claim 1, wherein the liner is thermally cured to the body to produce a cross-linked polymer network.

11. The container of claim 1, wherein the liner comprises a functional additive package tuned to a beverage chemistry.

12. The container of claim 11, wherein the functional additive package comprises:

oxygen-scavenging agents selected from ascorbate salts or hindered phenolics;

metal-ion chelators selected from ethylenediaminetetraacetic acid derivatives or citrate complexes; and a sulfur-interactive moiety configured to immobilize volatile reduced sulfur species at the liner.

13. The container of claim 1, wherein permeability characteristics of the liner are based on oxygen barrier performance.

14. The container of claim 1, wherein the container is configured to contain the acidic or reactive beverage comprising a free copper concentration of 0.2 ppm or less.

15. The container of claim 1, wherein dissolved oxygen levels of the acidic or reactive beverage in the container does not exceed 1.2 ppm.

16. The container of claim 1, wherein an internal pressure within the body filled with a beverage, when at rest at 70° F., is in a range from approximately 10 to 60 psi.

17. The container of claim 16, wherein the liner comprises elastic recovery and adhesion properties sufficient to maintain cohesion under cyclic pressure up to 90 psi without blistering or microcracking.

18. The container of claim 1, wherein the liner is configured to resist degradation at hot-fill temperatures.

19. A beverage-compatible container with resistance to degradation, the container comprising:

a body comprising a sidewall with an interior surface forming a cavity configured to hold an acidic or reactive beverage;

a liner disposed on at least a portion of the interior surface and configured to:

chemically isolate the interior surface of the body from the acidic or reactive beverage by resisting corrosion, oxidation, and sulfur-induced degradation; and preserve oxygen and sulfur barrier performance throughout storage of the acidic or reactive beverage within the body, wherein the liner comprises a multilayer architecture comprising:

a functional barrier layer;

a surface layer; and an adhesion-promoter sublayer.

20. A beverage-compatible container with resistance to degradation, the container comprising:

a body comprising a sidewall with an interior surface forming a cavity configured to hold an acidic or reactive beverage; and a liner disposed on at least a portion of the interior surface and configured to:

chemically isolate the interior surface of the body from the acidic or reactive beverage by resisting corrosion, oxidation, and sulfur-induced degradation; and preserve oxygen and sulfur barrier performance throughout storage of the acidic or reactive beverage within the body, wherein the liner comprises a functional additive package tuned to a beverage chemistry, wherein the functional additive package comprises:

oxygen-scavenging agents selected from ascorbate salts or hindered phenolics;

metal-ion chelators selected from ethylenediaminetetraacetic acid derivatives or citrate complexes; and a sulfur-interactive moiety configured to immobilize volatile reduced sulfur species at the liner.

* * * * *